US010582587B1

(12) United States Patent
Li

(10) Patent No.: US 10,582,587 B1
(45) Date of Patent: Mar. 3, 2020

(54) LED DIMMING METHOD, REGULATABLE LED DRIVER, ELECTRONIC APPARATUS AND READABLE STORAGE MEDIUM

(71) Applicant: Blueview Elec-Optic Tech Co., Ltd., Chengdu, Sichuan Province (CN)

(72) Inventor: Zhongxun Li, Chengdu (CN)

(73) Assignee: Blueview Elec-Optic Tech Co., Ltd., Chengdu (CN)

( * ) Notice: Subject to any disclaimer, the term of this patent is extended or adjusted under 35 U.S.C. 154(b) by 0 days.

(21) Appl. No.: 16/206,702

(22) Filed: Nov. 30, 2018

(30) Foreign Application Priority Data

Aug. 28, 2018 (CN) ..... 2018 1 0991517

(51) Int. Cl.
*H05B 37/02* (2006.01)
*H05B 37/00* (2006.01)
*H05B 33/08* (2020.01)

(52) U.S. Cl.
CPC ..... *H05B 33/0866* (2013.01); *H05B 33/086* (2013.01); *H05B 33/0815* (2013.01); *H05B 37/0272* (2013.01)

(58) Field of Classification Search
CPC ..... H05B 33/0815; H05B 33/0818; H05B 41/2828; H05B 41/3921; H05B 41/3927; H05B 41/28; H05B 37/029; H05B 33/0803; H05B 37/0254; H05B 37/02; H05B 37/0272; H05B 37/0218; H05B 41/3922; Y02B 20/46; F21V 23/0442
See application file for complete search history.

(56) References Cited

U.S. PATENT DOCUMENTS

2012/0080944 A1* 4/2012 Recker ..... H02J 9/02 307/25
2015/0318685 A1* 11/2015 Hsieh ..... G06F 1/30 363/53
2015/0373796 A1* 12/2015 Bahrehmand ..... H05B 33/0815 315/129
2017/0324933 A1* 11/2017 Alrod ..... H04N 7/15
2018/0092189 A1* 3/2018 Reier ..... H05B 37/0236

* cited by examiner

*Primary Examiner* — Minh D A
(74) *Attorney, Agent, or Firm* — Leydig, Voit & Mayer, Ltd.

(57) ABSTRACT

An LED dimming method, a regulatable LED power supply, an electronic apparatus, and a readable storage medium are provided. The regulatable LED driver includes a main power supply circuit, a Bluetooth module, a Bluetooth control module, and a dimming circuit, the first dimming instruction sent by the control terminal is received through the Bluetooth module, the Bluetooth control module controls the dimming circuit to regulate an output power outputted to the LED load according to the first dimming instruction, so as to adjust a parameter of the LED load, so that the regulatable LED driver may be controlled by the control terminal remotely, enabling the flexible adjustment of the parameters of the LED load, and improving the convenience of adjusting a display parameter of the LED load.

16 Claims, 13 Drawing Sheets

LED DIMMING METHOD, REGULATABLE LED DRIVER, ELECTRONIC APPARATUS AND READABLE STORAGE MEDIUM

CROSS-REFERENCE TO RELATED APPLICATION

The present disclosure claims the priority to a Chinese patent application No. CN201810991517X, filed with the China Patent Office on Aug. 28, 2018 and entitled "A regulatable LED driver and LED dimming method", the content of which is incorporated herein by reference in entirety.

TECHNICAL FIELD

The present disclosure relates to the field of LED technologies, and in particular to an LED dimming method, a regulatable LED driver, an electronic apparatus, and a readable storage medium.

BACKGROUND OF THE INVENTION

With the rapid development of science and technology, LED products are continuously developed and replaced, LED products are initially required for enabling energy saving while achieving illumination, now, with the increase and transformation of the application fields of LED products, LED products are no longer just required for illumination and energy saving, requirements are further made on technical indexes such as a brightness, a color temperature and a color of the LED products. However, after the existing LED lamps are installed in the same place, they usually only luminate at a fixed brightness, color temperature and color, and they can only be switched wholly, such that it is not only difficult to meet the demands of changes in brightness, color temperature and color of LED products, but also would damage the service life of power supply and lamp beads because the LED lamps are in a state of high brightness and high color temperature for a long period of time, which is not favorable to the long-term and constant use of the LED products. Therefore, smart LED products with variable technical indexes such as a brightness, a color temperature and a color have become the goals that we pursue.

BRIEF DESCRIPTION OF DRAWINGS

The present disclosure will be further described below in conjunction with the accompanying drawings and embodiments, in which.

Figure 1:
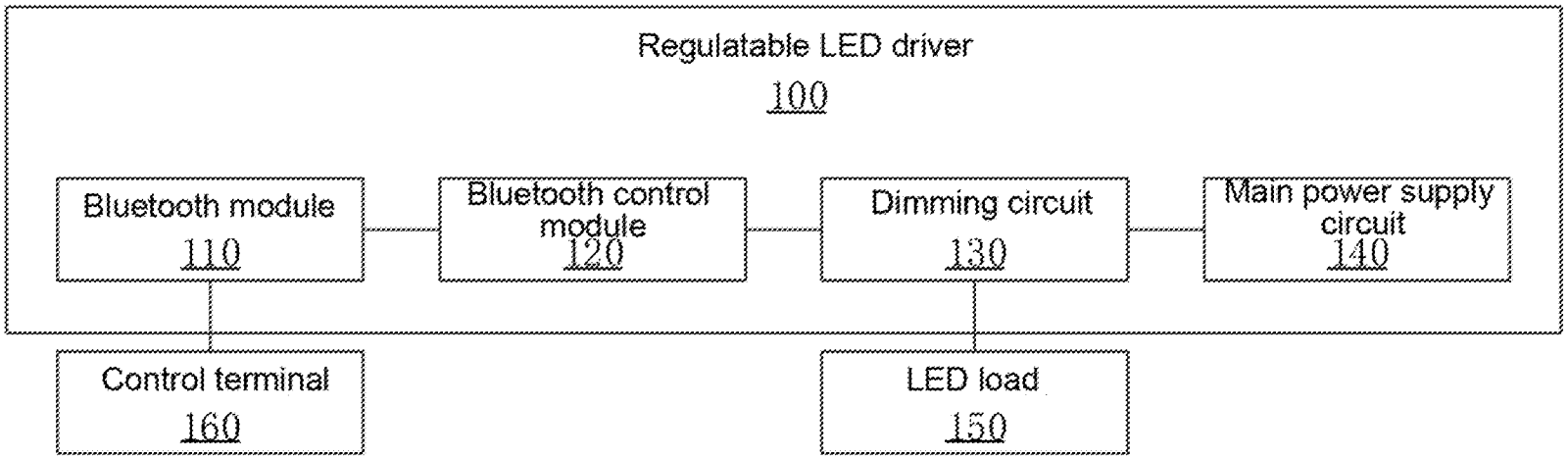
FIG. 1 is a structural block diagram of a regulatable LED driver provided by the present disclosure.

List of Reference signs: 100—regulatable LED driver; 110—Bluetooth module; 120—Bluetooth control module; 130—dimming circuit; 140—main power supply circuit; 142—optically coupling circuit; 144—switch power supply control circuit; 146—transformer; 148—voltage regulating circuit; 150—LED load; 160—control terminal; 170—pre-stage PFC circuit; 181—front panel control circuit; 182—clock circuit; 183—reset circuit; 184—filter circuit; 200—electronic apparatus; 203—memory; 204—storage controller; and 205—processor.

DETAILED DESCRIPTION

In order to make the object, technical solution and advantages of the present disclosure clearer, the technical solutions of the present disclosure will be clearly and completely described in the following with reference to the accompanying drawings, and it is apparent that the described embodiments are some but not all of the embodiments of the present disclosure. The components of the present disclosure, which are generally described and illustrated in the figures herein, may be arranged and designed in a variety of different configurations.

Therefore, the detailed description of the embodiments of the present disclosure set forth in the accompanying drawings is not intended to limit the claimed scope of the present disclosure, but illustrate only selected embodiments of the present disclosure. All other embodiments, obtained by those skilled in the art in light of the embodiments of the present invention without inventive efforts, will fall within the claimed scope of the present disclosure.

It should be noted that similar reference numerals and letters indicate similar items in the following figures, and therefore, once an item is defined in a drawing, it is not necessary to further define or explain it in the subsequent drawings. It should also be indicated that various embodiments in the description are described in a progressive manner, and each embodiment focuses on differences from other embodiments, and the same similar parts between various embodiments may be referred to each other.

In the description of the present disclosure, it should be indicated that orientation or positional relations indicated by terms such as "center", "up", "down", "left", "right", "vertical", "horizontal", "inside", and "outside" are based on the orientation or positional relations as shown in the figures, or the conventionally placed orientation or positional relationship when the inventive product is used, only for facilitating description of the present disclosure and simplifying the description, rather than indicating or implying that the referred devices or elements must be in a particular orientation or constructed or operated in the particular orientation, and therefore they should not be construed as limiting the present disclosure. In addition, terms such as "first", "second", "third" and "fourth" are used only for distinguishing the description, and should not be understood as indicating or implying to have importance in relativity.

In addition, terms "horizontal", "vertical", "overhanging", etc. are not intended to mean that the member is required to be absolutely horizontal or overhanging, but may be slightly inclined. For example, the term "horizontal" merely means that its direction is more horizontal with respect to "vertical", and does not mean that the structure must be completely horizontal, but may be slightly inclined.

In the description of the present disclosure, it also should be indicated that unless otherwise expressly specified or defined, terms "provide", "mount", "couple", and "connect" should be understood broadly, and for example, a connection may be a fixed connection, or a detachable connection, or an integrated connection; may be a mechanical connection or an electric connection; or may be a direct connection, or an indirect connection via an intermediate medium, or may be an internal communication between two elements. The specific meanings of the above-mentioned terms in the present disclosure could be understood by those skilled in the art according to specific situations.

Optional embodiments of the present disclosure will now be described in detail with reference to the accompanying drawings.

FIG. 1 is a structural block diagram of a regulatable LED driver provided by the present disclosure, and as shown in FIG. 1, the present disclosure provides an optional embodiment of a regulatable LED driver 100.

The regulatable LED driver 100 includes a Bluetooth module 110, a Bluetooth control module 120, a dimming circuit 130, and a main power supply circuit 140. The main power supply circuit 140 is connected with the dimming circuit 130, the dimming circuit 130 is configured to be connected with an LED load 150, the Bluetooth module 110 is connected with the Bluetooth control module 120, the Bluetooth control module 120 is connected with the dimming circuit 130, and the Bluetooth module 110 is configured to be connected with a control terminal 160.

When a display parameter of the LED load 150 is adjusted remotely, a first dimming instruction may be sent by the control terminal 160. The control terminal 160 may be a smart terminal apparatus, such as a mobile phone, a personal computer and a PAD.

The Bluetooth module 110 may be in Bluetooth connection with the control terminal 160 in advance, and the Bluetooth module 110 may receive the first dimming instruction sent by the control terminal 160 and send the first dimming instruction to the Bluetooth control module 120.

The Bluetooth control module 120 is configured to control the dimming circuit 130 to regulate (adjust) an output power outputted to the LED load 150 according to the first dimming instruction, so as to adjust a display parameter of the LED load 150.

The Bluetooth control module 120 is a Bluetooth mesh control board, which may network a plurality of regulatable LED driver 100 with the mesh technology, so that the control terminal 160 may remotely control a plurality of the regulatable LED driver 100.

The display parameter of the LED load 150 includes a brightness, a color temperature or a color of the LED load 150.

Herein, the power supply of the Bluetooth module 110 may be continuously powered by a Bluetooth auxiliary winding circuit, after the power supply switch of the regulatable LED driver 100 is turned on, the power supply indicator light on the regulatable LED driver 100 lights up, and the main power supply circuit 140 starts to work, and supplies power to each of the power consuming modules of the regulatable LED driver 100.

The dimming circuit 130 may regulate a voltage or current outputted to the LED load 150, when a brightness of the LED load 150 is adjusted to increase, the voltage or current outputted to the LED load 150 may be increased, that is, the output power outputted to the LED load 150 is increased, such that the brightness of the LED load 150 is increased, in this way, a color temperature or a color of the LED load 150 may be adjusted accordingly, therefore, the display parameter of the LED load 150 may be flexibly adjusted by remotely controlling the regulatable LED driver 100 through the control terminal 160.

In addition, in case of no control terminal 160, or in case that the control terminal 160 cannot be connected with the regulatable LED driver 100, there is a dimming knob further included, that is, a dimming knob is provided on the Bluetooth mesh control board, and a user may input a second dimming instruction by adjusting the dimming knob, that is, the dimming knob is configured to input the second dimming instruction, and there is a Bluetooth control module 120 further configured to control the dimming circuit 130 to regulate an output power outputted to the LED load 150 according to the second dimming instruction, so as to adjust a display parameter of the LED load 150.

In case of receiving the first dimming instruction and the second dimming instruction at the same time, the Bluetooth control module 120 preferably responds to the second dimming instruction, and does not respond to the first dimming instruction, that is, regulating the output power outputted to the LED load 150 according to the second dimming instruction, in case of receiving the first dimming instruction and then the second dimming instruction successively, that is, in case of receiving the first dimming instruction first, and then receiving the second dimming instruction, it responds to the dimming instruction received later, that is, the second dimming instruction.

Of course, the Bluetooth control module 120 may also set its own rules, that is, after receiving two dimming instructions, the Bluetooth control module 120 may select one of the dimming instructions to respond according to the self-set rules.

Figure 2:
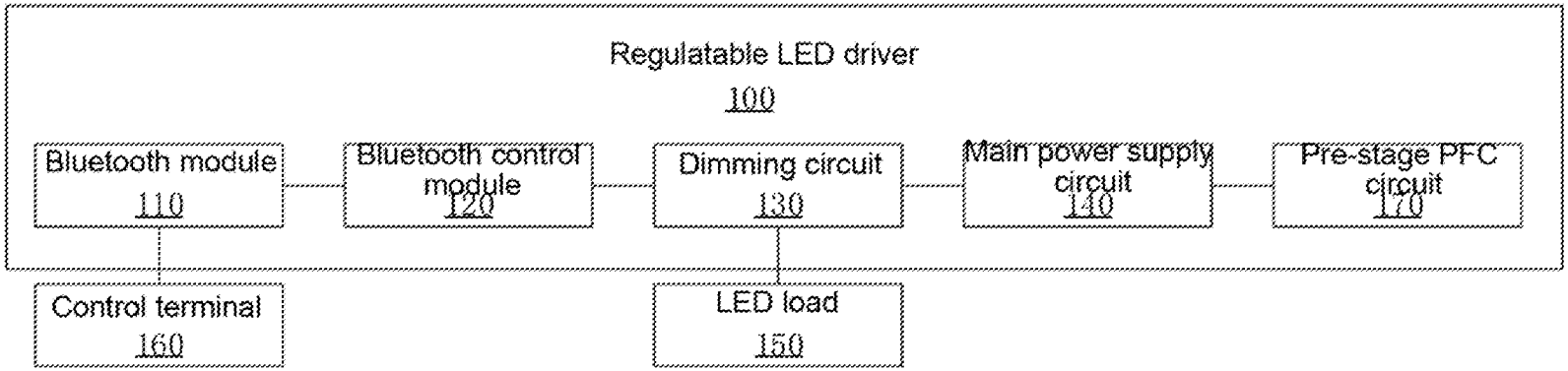
FIG. 2 is a structural block diagram of another regulatable LED driver provided by the present disclosure.

Optionally, FIG. 2 is a structural block diagram of another regulatable LED driver provided by the present disclosure, which provides a possible implementation of a regulatable LED driving power supply, specifically, referring to FIG. 2, the regulatable LED driver 100 further includes a pre-stage PFC circuit, the pre-stage PFC circuit is connected with an input power supply, the pre-stage PFC circuit is connected with the main power supply circuit 140, and the main power supply circuit 140 is connected with the dimming circuit 130.

The pre-stage PFC circuit 170 is configured to boost the input power supply, that is, the input power supply is a 220V commercial power supply, and it is boosted by the pre-stage PFC circuit 170 to 400V and then outputted to the main power supply circuit 140.

Figure 3:
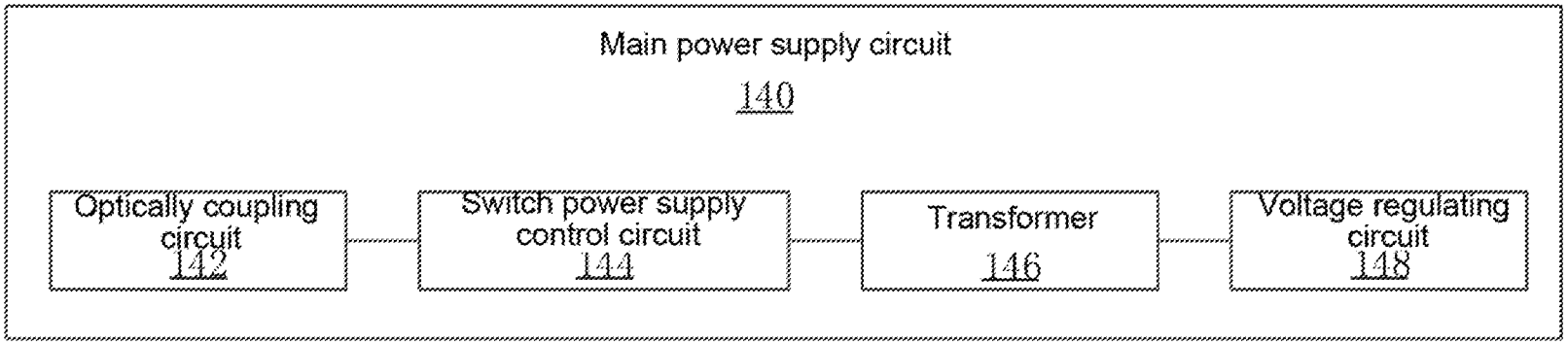
FIG. 3 is a structural block diagram of a main power supply circuit provided by the present disclosure.

Optionally, FIG. 3 is a structural block diagram of a main power supply circuit provided by the present disclosure, which provides a possible implementation of a main power supply circuit, specifically, referring to FIG. 3, the main power supply circuit 140 includes an optically coupling circuit 142, a switch power supply control circuit 144, a transformer 146 and a voltage regulating circuit 148, the optically coupling circuit 142 is connected with the switch power supply control circuit 144 and the dimming circuit 130 respectively, the switch power supply control circuit 144 is connected with the pre-stage PFC circuit, the switch power supply control circuit 144 is connected with the transformer 146, the transformer 146 is connected with the voltage regulating circuit 148, and the voltage regulating circuit 148 is connected with the dimming circuit 130.

Figure 4:
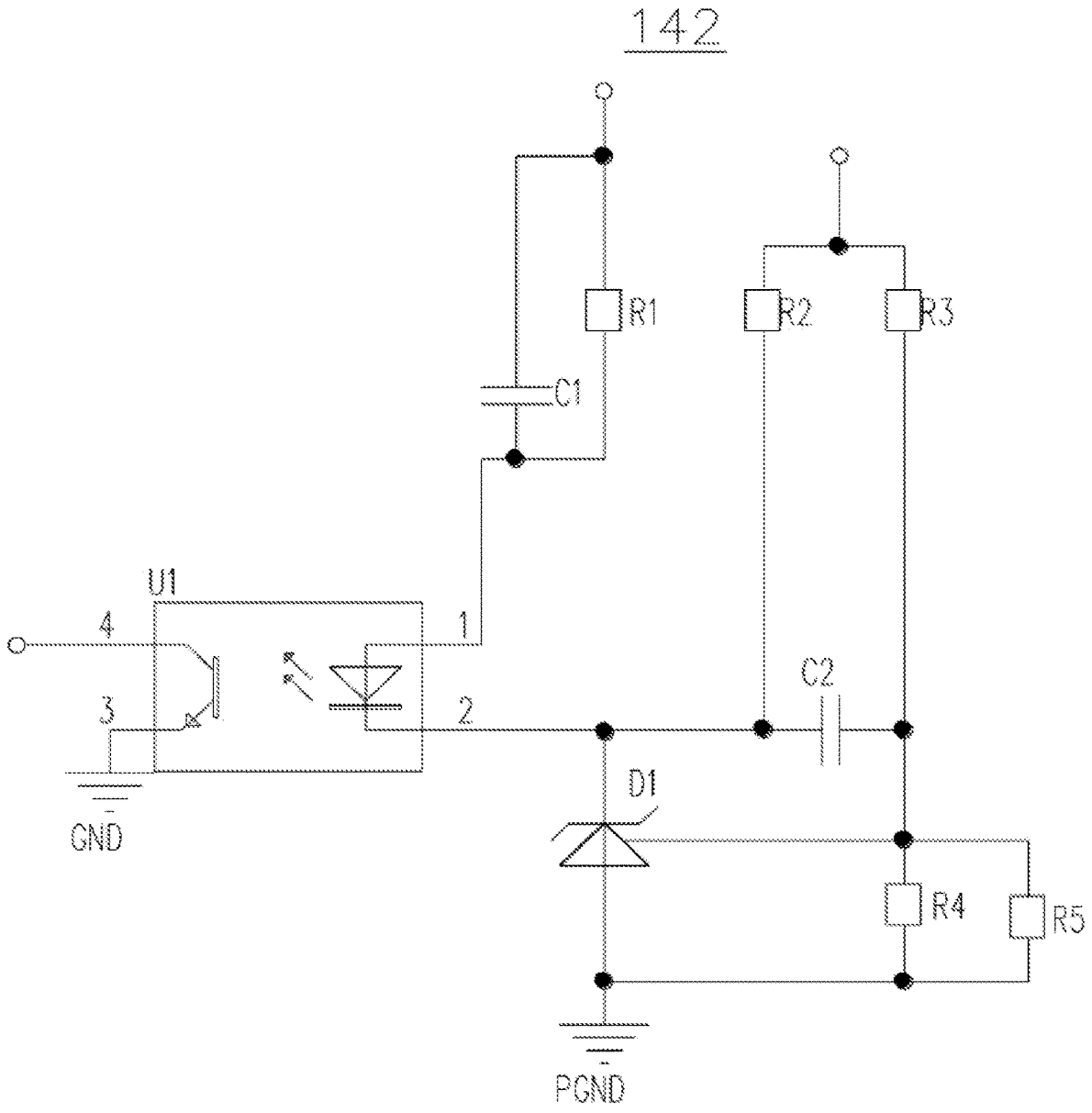
FIG. 4 is a circuit schematic diagram of an optically coupling circuit provided by the present disclosure.

Optionally, FIG. 4 is a circuit schematic diagram of an optically coupling circuit provided by the present disclosure, which provides an implementation of an optically coupling circuit, specifically, referring to FIG. 4, the optically coupling circuit 142 includes an optical coupler U1, a first capacitor C1, a second capacitor C2, a first resistor R1, a second resistor R2, a third resistor R3, a fourth resistor R4, a fifth resistor R5 and a first diode D1, an output end of the optical coupler U1 is connected with the main power supply circuit 140, an input end of the optical coupler U1 is connected with one end of the first capacitor C1, the input end of the optical coupler U1 is also connected with a cathode of the first diode D1, the other end of the first capacitor C1 is connected with the main power supply circuit 140, one end of the first capacitor C1 is connected with one end of the first resistor R1, and the other end of the first resistor R1 is connected with the main power supply circuit 140, the cathode of the first diode D1 is connected with one end of the second resistor R2 and one end of the second capacitor C2 respectively, an anode of the first diode D1 is grounded, the other end of the second resistor R2 and the other end of the third resistor R3 are connected with the main power supply circuit 140, the other end of the third resistor R3 is connected with the other end of the second capacitor C2 and one end of the fourth resistor R4, one end of the fourth resistor R4 is connected with the first diode D1, the other end of the fourth resistor R4 is grounded, one end of the fourth resistor R4 is also connected with one end of the fifth resistor R5, and the other end of the fifth resistor R5 is grounded.

Figure 5:
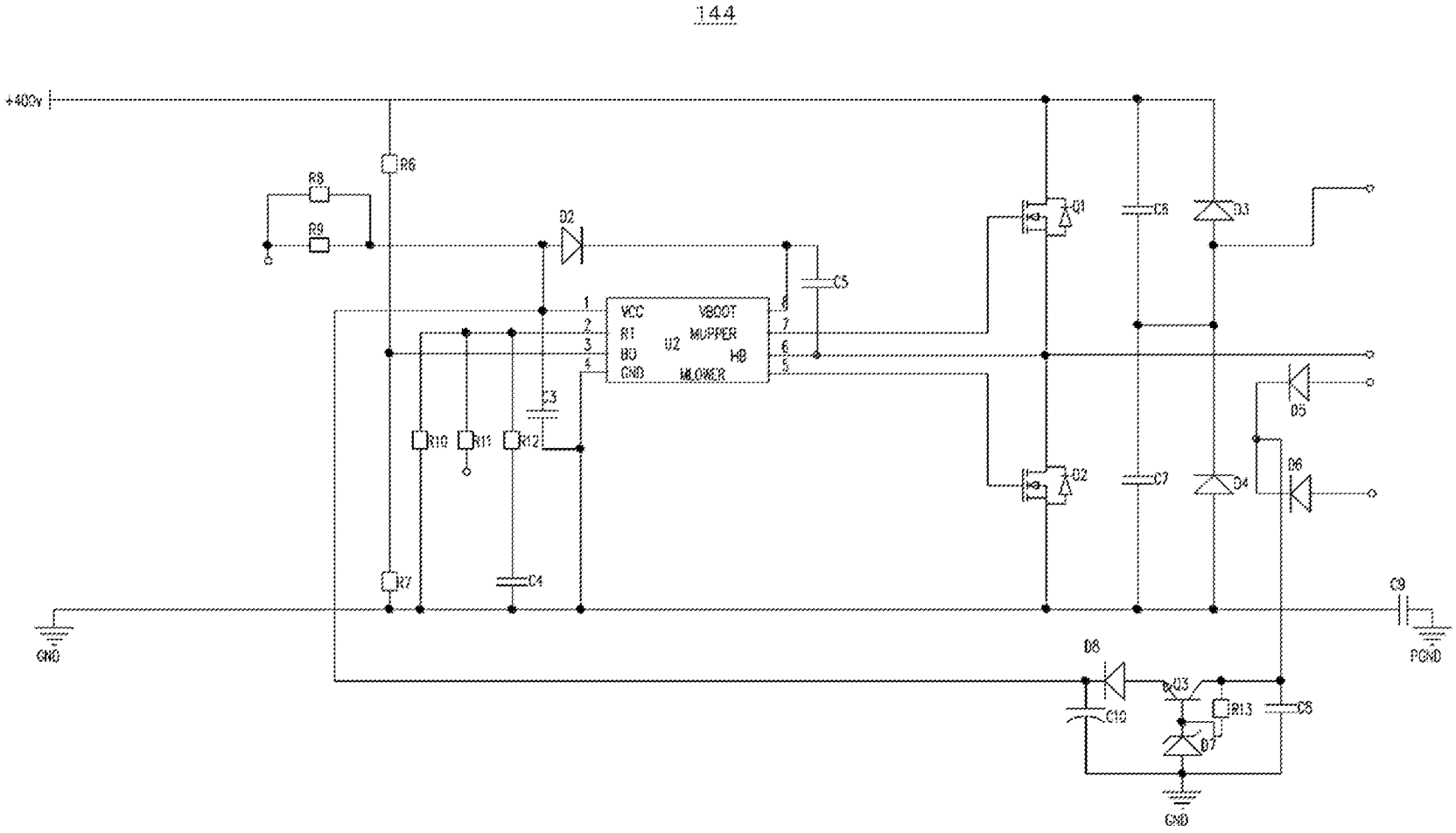
FIG. 5 is a circuit schematic diagram of a switch power supply control circuit provided by the present disclosure.

Optionally, FIG. 5 is a circuit schematic diagram of a switch power supply control circuit provided by the present disclosure, which provides a possible implementation of a switch power supply control circuit, specifically, referring to FIG. 5, the switch power supply control circuit 144 includes a sixth resistor R6, a seventh resistor R7, an eighth resistor R8, a ninth resistor R9, a tenth resistor R10, an eleventh resistor R11, a twelfth resistor R12, a thirteenth resistor R13, a second diode D2, a third diode D3, a fourth diode D4, a fifth diode D5, a sixth diode D6, a seventh diode D7, an eighth diode D8, a third capacitor C3, a fourth capacitor C4, a fifth capacitor C5, a sixth capacitor C6, a seventh capacitor C7, an eighth capacitor C8, a ninth capacitor C9, a tenth capacitor C10, a first field effect tube Q1, a second field effect tube Q2, a first triode Q3 and a switch power supply chip U2, one end of the sixth resistor R6 is connected with the pre-stage PFC circuit, the other end of the sixth resistor R6 is connected with the switch power supply chip U2 and one end of the seventh resistor R7, one end of the eighth resistor R8 and one end of the ninth resistor R9 are connected with the pre-stage PFC circuit, the other end of the eighth resistor R8 and the other end of the ninth resistor R9 are connected with an anode of the third diode D3, an anode of the second diode D2 is connected with one end of the third capacitor C3, and the other end of the third capacitor C3 is grounded, one end of the tenth resistor R10, one end of the eleventh resistor R11 and one end of the twelfth resistor R12 are connected with the switch power supply chip U2, and the other end of the tenth resistor R10 is grounded, the other end of the eleventh resistor R11 is connected with the pre-stage PFC circuit, the other end of the twelfth resistor R12 is connected with one end of the fourth capacitor C4, the other end of the fourth capacitor C4 is grounded, and a cathode of the second diode D2 is connected with one end of the fifth capacitor C5, the other end of the fifth capacitor C5 is connected with the switch power supply chip U2, a gate of the first field effect tube Q1 is connected with the switch power supply chip U2, a source of the first field effect tube Q1 is connected with the switch power supply chip U2, a drain of the first field effect tube Q1 is connected with the pre-stage PFC circuit, a gate of the second field effect tube Q2 is connected with a locked switch power supply chip U2, a drain of the second field effect tube Q2 is connected with the switch power supply chip U2, a source of the second field effect tube Q2 is grounded, one end of the sixth capacitor C6 is connected with the pre-stage PFC circuit, the other end of the sixth capacitor C6 is connected with one end of the seventh capacitor C7, and the other end of the seventh capacitor C7 is grounded, a cathode of the third diode D3 is connected with the pre-stage PFC circuit, an anode of the third diode D3 is connected with the transformer 146 and a cathode of the fourth diode D4, an anode of the fourth diode D4 is grounded, a cathode of the fifth diode D5 and a cathode of the sixth diode D6 are both connected with one end of the eighth capacitor C8, one end of the ninth capacitor C9 is connected with the anode of the fourth diode D4, the other end of the ninth capacitor C9 is grounded, one end of the thirteenth resistor R13 is connected with one end of the eighth capacitor C8, a base of the first triode Q3 is connected with a cathode of the seventh diode D7, an emitter of the first triode Q3 is connected with an anode of the eighth diode D8, a cathode of the eighth diode D8 is connected with the switch power supply chip U2, the cathode of the eighth diode D8 is connected with one end of the tenth capacitor C10, the other end of the tenth capacitor C10 is grounded, an anode of the seventh diode D7 is grounded, and the other end of the eighth capacitor C8 is grounded.

The model of the switch power supply chip U2 is NCP1392.

Figure 6:
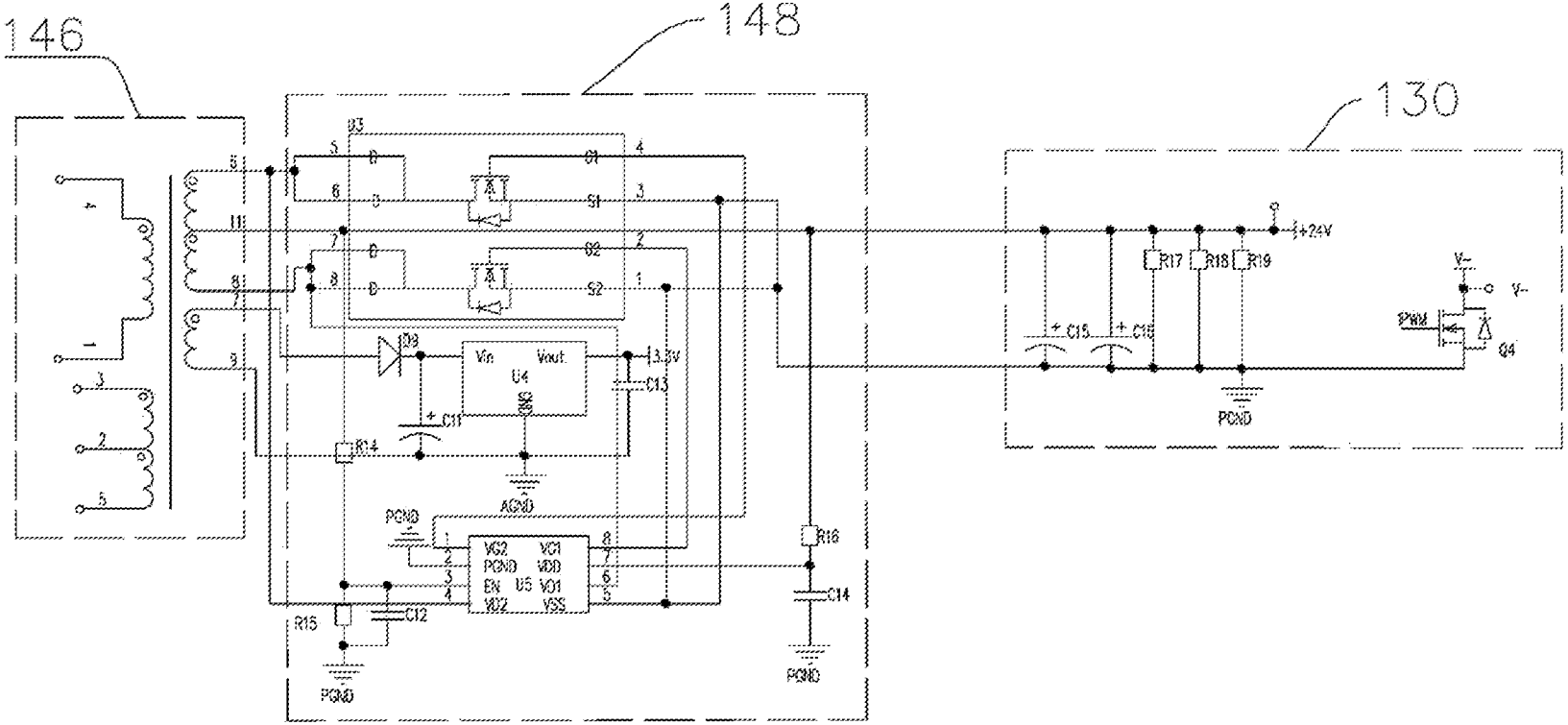
FIG. 6 is a circuit schematic diagram of a transformer, a voltage regulating circuit, and a dimming circuit provided by the present disclosure.

Optionally, FIG. 6 is a circuit schematic diagram of a transformer, a voltage regulating circuit, and a dimming circuit provided by the present disclosure, which provides a possible implementation of a transformer, a voltage regulating circuit, and a dimming circuit, specifically, referring to FIG. 6, a primary side coil of the transformer 146 is connected with the switch power supply control circuit 144, and a secondary side coil of the transformer 146 is connected with the dimming circuit 130.

The voltage regulating circuit 148 includes a micro control chip U3, a buck chip U4, a power supply chip U5, a fourteenth resistor R14, a fifteenth resistor R15, a sixteenth resistor R16, an eleventh capacitor C11, a twelfth capacitor C12, and a thirteenth capacitor C13, a fourteenth capacitor C14 and a ninth diode D9, the micro control chip U3 is connected with the secondary side coil of the transformer, the micro control chip U3 is connected with the dimming circuit 130, an anode of the ninth diode D9 is connected with the secondary side coil of the transformer, a cathode of the ninth diode D9 is connected with the buck chip U4, the cathode of the ninth diode D9 is also connected with one end of the eleventh capacitor C11, and the other end of the eleventh capacitor C11 is connected with the secondary side coil of the transformer, one end of the fourteenth resistor R14 is connected with the secondary side coil of the transformer, the other end of the fourteenth resistor R14 is connected with one end of the fifteenth resistor R15, the other end of the fifteenth resistor R15 is grounded, one end of the twelfth capacitor C12 is connected with the power supply chip U5, the other end of the twelfth capacitor C12 is grounded, one end of the thirteenth capacitor C13 is connected with the buck chip U4, the other end of the thirteenth capacitor C13 is connected with the secondary coil side of the transformer, one end of the sixteenth resistor R16 is connected with the micro controller chip U3, the other end of the sixteenth resistor R16 is connected with one end of the fourteenth capacitor C14, and the other end of the fourteenth capacitor C14 is grounded.

Herein, the model of the micro control chip U3 is Q-65DN3LLH5, the model of the buck chip U4 is AMS1117, and the model of the power supply chip U5 is MP6922.

The dimming circuit 130 is a post-polarization dimming chopper circuit.

The post-polarization dimming chopper circuit includes a fifteenth capacitor C15, a sixteenth capacitor C16, a seventeenth resistor R17, an eighteenth resistor R18, a nineteenth resistor R19, and a third field effect tube Q4, one end of the fifteenth capacitor C15, one end of the sixteenth capacitor C16, one end of the seventeenth resistor R17, one end of the eighteenth resistor R18, and one end of the nineteenth resistor R19 are all connected with the micro control chip U3, the other end of the fifteenth capacitor C15, the other end of the sixteenth capacitor C16, the other end of the seventeenth resistor R17, the other end of the eighteenth resistor R18, and the other end of the nineteenth resistor R19 are all grounded, a source of the third field effect tube Q4 is grounded, a gate of the third field effect tube Q4 is connected with the LED load 150, and a drain of the third field effect tube Q4 is connected with the optically coupling circuit 142.

Figure 7:
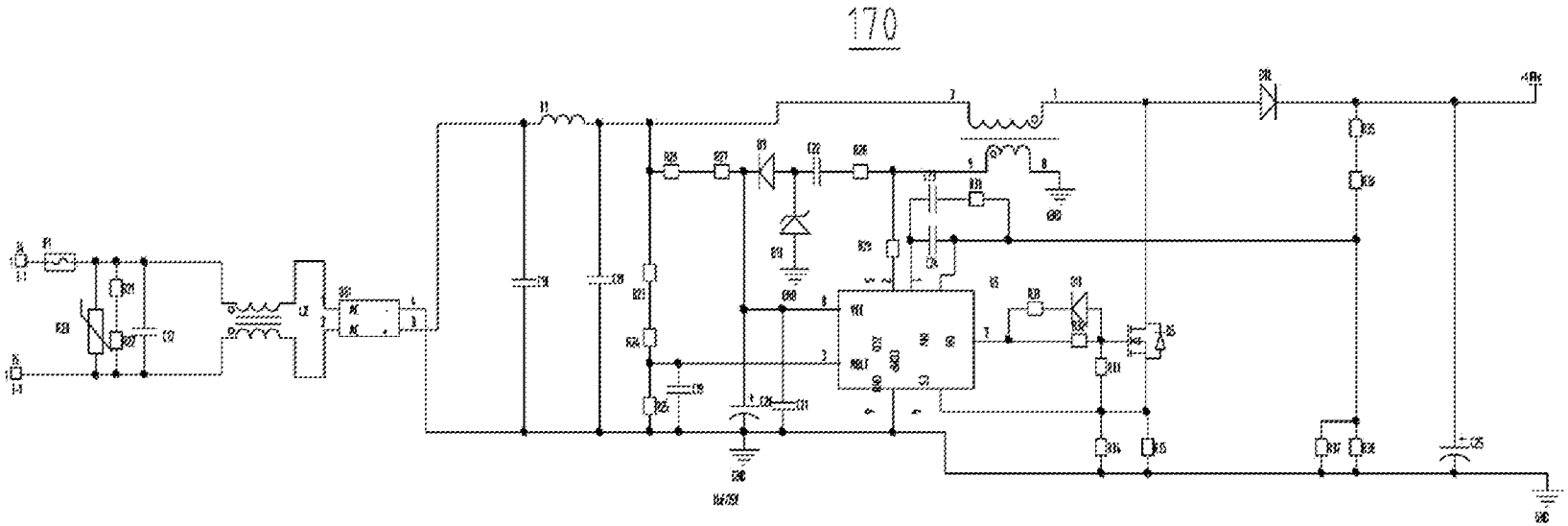
FIG. 7 is a circuit schematic diagram of a pre-stage PFC circuit provided by the present disclosure.

Optically, FIG. 7 is a circuit schematic diagram of a pre-stage PFC circuit provided by the present disclosure, which provides a possible implementation of a pre-stage PFC circuit, specifically, referring to FIG. 7, FIG. 7 is a circuit schematic diagram of the pre-stage PFC circuit 170, and the connection relationship of each element in the pre-stage PFC circuit 170 are as shown in FIG. 7.

Figure 8:
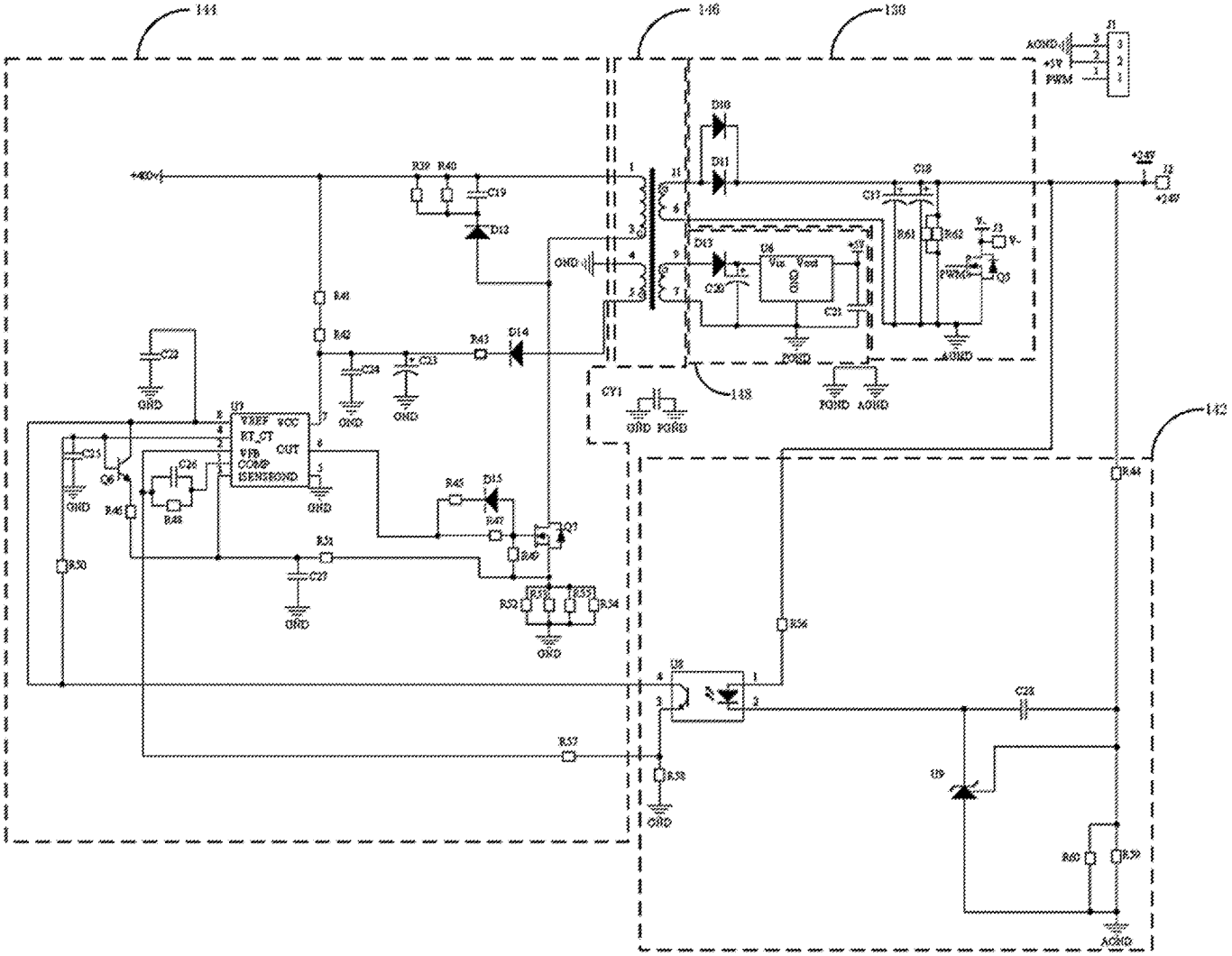
FIG. 8 is a circuit schematic diagram of another main power supply circuit and dimming circuit provided by the present disclosure.

Optionally, the present disclosure further provides another possible implementation regarding to the main power supply circuit 140 and the dimming circuit 130:

FIG. 8 is a circuit schematic diagram of another main power supply circuit and dimming circuit provided by the present disclosure, referring to FIG. 8, the switch power supply control circuit 144 includes: a thirty-ninth resistor R39, a fortieth resistor R40, a forty-first Resistor R41, a forty-second resistor R42, a forty-third resistor R43, a forty-fifth resistor R45, a forty-sixth resistor R46, a forty-seventh resistor R47, a forty-eighth resistor R48, a forty-ninth resistor R49, a fiftieth resistor R50, a fifty-first resistor R51, a fifty-second resistor R52, a fifty-third resistor R53, a fifty-fourth resistor R54, a fifty-fourth resistor R55, a fifty-seventh resistor R57, a power supply management chip U7, a nineteenth capacitor C19, a twenty-second capacitor C22, a twenty-third polarity capacitor C23, a twenty-fourth capacitor C24, a twenty-fifth capacitor C25, a twenty-sixth capacitor C26, a twenty-seventh capacitor C27, a twelfth diode D12, a fourteenth diode D14, a fifteenth diode D15, a second triode Q6, and a fifth field effect tube Q7.

Herein, one end of the thirty-ninth resistor R39, one end of the fortieth resistor R40, and one end of the nineteenth capacitor C19 are all connected with the pre-stage PFC circuit and one end 1 of a primary coil in the transformer 146, the other end the thirty-ninth resistor R39, the other end of the fortieth resistor R40, and the other end of the nineteenth capacitor C19 are all connected with a negative electrode of the twelfth diode D12; a positive electrode of the twelfth diode D12 is connected with the other end 3 of the primary coil in the transformer 146 and a drain of the fifth field effect tube Q7 respectively; a source of the fifth field effect tube Q7 is connected with one end of the fifty-first resistor R51, one end of the fifty-second resistor R52, one end of the fifty-third resistor R53, one end of the fifty-fourth resistor R54 and one end of the fifty-fifth resistor R55 respectively; a gate of the fifth field effect tube Q7 is connected with a positive electrode of the fifteenth diode D15, one end of the forty-seventh resistor R47 and one end of the forty-ninth resistor R49 respectively; the other end of the forty-ninth resistor R49 is connected with one end of the fifty-first resistor R51 and a source of the fifth field effect tube Q7 respectively; a negative electrode of the fifteenth diode D15 is connected with one end of the forty-fifth resistor R45; the other end of the forty-fifth resistor R45 is connected with the power supply management chip U7 (optionally connected to a pin 6 of the power supply management chip U7) and the other end of the forty-seventh resistor R47 respectively; and the other end of the fifty-second resistor R52, the other end of the fifty-third resistor R53, the other end of the fifty-fourth resistor R54, and the other end of the fifty-fifth resistor R55 are all grounded;

The other end of the fifty-first resistor R51 is connected with one end of the twenty-seventh capacitor C27, the power supply management chip U7 (optionally, a pin 3 of the power supply management chip U7), and one end of the forty-sixth resistor R46 respectively; the other end of the twenty-seventh capacitor C27 is grounded; the other end of the forty-sixth resistor R46 is connected with an emitter of a second triode Q6; a base of the second triode Q6 is connected with one end of the twenty-fifth capacitor C25 and one end of the fiftieth resistor R50 respectively; a collector of the second triode Q6 is connected with the power supply management chip U7 (optionally, a pin 8 of the power supply management chip U7), the other end of the twenty-second capacitor C22, and the optical coupler U8 (optionally, a pin 4 of the optical coupler U8), respectively; the other end of the twenty-fifth capacitor C25 is grounded; the other end of the twenty-second capacitor C22 is grounded; and the other end of the fiftieth resistor R50 is connected with the optical coupler U8 (optionally, a pin 4 of the optical coupler U8);

One end of the twenty-sixth capacitor C26 and one end of the forty-eighth resistor R48 each are connected with the power supply management chip U7 (optionally, a pin 2 of the power supply management chip U7) and one end of the fifty-seventh resistor R57 respectively; the other end of the twenty-sixth capacitor C26 and the other end of the forty-eighth resistor R48 are all connected with the power supply management chip U7 (optionally, a pin 1 of the power supply management chip U7); the other end of the fifty-seventh resistor R57 is connected with the optical coupler U8 (optionally, a pin 3 of the optical coupler U8) and one end of the fifty-eighth resistor R58 respectively; and the other end of the fifty-eighth resistor R58 is grounded.

One end 4 of an induction coil in the transformer 146 is grounded; the other end 5 of the induction coil in the transformer 146 is connected with a positive electrode of the fourteenth diode D14; a negative electrode of the fourteenth diode D14 is connected with one end of the forty-third resistor R43; the other end of the forty-third resistor R43 is connected with a positive electrode of the twenty-third polarity capacitor C23, one end of the twenty-fourth capacitor C24, one end of the forty-second resistor R42, and the power supply management chip U7 (optionally, a pin 7 of the power supply management chip U7), respectively; a negative electrode of the twenty-third polarity capacitor C23 and the other end of the twenty-fourth capacitor C24 are respectively grounded GND; the other end of the forty-second resistor R42 is connected with one end of the forty-first resistor R41; the other end of the forty-first resistor R41 is connected with one end of the thirty-ninth resistor R39 and the pre-stage PFC circuit, respectively.

Optionally, the model of the power supply management chip U7 may be UC3844. The model of the twelfth diode D12 may be RS1M. The model of the fifteenth diode D15 may be 1N4148. The model of the fifth field effect tube Q7 may be NMOS-STD16N65M5.

Still referring to FIG. 8, the optically coupling circuit 142 includes: a forty-fourth resistor R44, a fifty-sixth resistor R56, a fifty-eighth resistor R58, a fifty-ninth resistor R59, a sixtieth resistor R60, an optical coupler U8, a twenty-eighth capacitor C28, and a voltage regulating tube U9;

One end of the fifty-sixth resistor R56 is connected with the optical coupler U8 (optionally connected to a pin 1 of the optical coupler U8); the optical coupler U8 (optionally, a pin 2 of the optical coupler U8) is connected with a cathode of the voltage regulating tube U9 and one end of the twenty-eighth capacitor C28 respectively; an anode of the voltage regulating tube U9 is connected with one end of the fifty-ninth resistor R59, one end of the sixtieth resistor R60, and an analog ground AGND, respectively; the other end of the fifty-ninth resistor R59 and the other end of the sixtieth resistor R60 are connected with a reference electrode of the voltage regulating tube U9, the other end of the twenty-eighth capacitor C28, and one end of the forty-fourth resistor R44, respectively; the optical coupler U8 (optionally, a pin 3 of the optical coupler U8) is connected with the other end of the fifty-seventh resistor R57 and one end of the fifty-eighth resistor R58 respectively; the optical coupler U8 (optionally, a pin 4 of the optical coupler U8) is connected with the other end of the fiftieth resistor R50; the other end of the fifty-eighth resistor R58 is grounded.

Optionally, the model of the optical coupler U8 may be PC817. The model of the voltage regulating tube U9 may be TL431.

Still referring to FIG. 8, the voltage regulating circuit 148 includes: a thirteenth diode D13, a twentieth polarity capacitor C20, a twenty-first capacitor C21, and a buck chip U6; herein, one end 7 of a second secondary coil in the transformer 146 is connected with a negative electrode of the twentieth polarity capacitor C20, the buck chip U6 (optionally, a pin GND of the buck chip U6), one end of the twenty-first capacitor C21 and a protective ground PGND respectively; the other end 9 of the second secondary coil in the transformer 146 is connected with a positive electrode of the thirteenth diode D13; a negative electrode of the thirteenth diode D13 is connected with a positive electrode of the twentieth polarity capacitor C20 and the buck chip U6 (optionally, a pin Vin of the buck chip U6) respectively; the buck chip U6 (optionally, a pin Vout of the buck chip U6) is connected with the other end of the twenty-first capacitor C21.

Optionally, the model of the buck chip U6 may be AMS1117. The model of the thirteenth diode D13 may be SS26.

Still referring to FIG. 8, the dimming circuit 130 includes: a sixty-first resistor R61, a sixty-second resistor R62, a seventeenth polarity capacitor C17, an eighteenth polarity capacitor C18, a tenth diode D10, an eleventh diode D11, and a fourth field effect tube Q5.

Herein, one end 6 of a first secondary coil in the transformer 146 is connected with a negative electrode of the seventeenth polarity capacitor C17, a negative electrode of the eighteenth polarity capacitor C18, one end of the sixty-first resistor R61, one end of the sixty-second resistor R62, an analog ground AGND and a source of the fourth field effect tube Q5 respectively; a positive electrode of the seventeenth polarity capacitor C17, a positive electrode of the eighteenth polarity capacitor C18, the other end of the sixty-first resistor R61 and the other end of the sixty-second resistors R62 are all connected with a negative electrode of the tenth diode D10, a negative electrode of the eleventh diode D11, one end of the fifty-sixth resistor R56, one end of the forty-fourth resistor R44, and a second interface J2, respectively; a positive electrode of the tenth diode D10 and a positive electrode of the eleventh diode D11 are all connected with the other end 11 of the first secondary coil in the transformer 146; a drain of the fourth field effect tube Q5 is connected with a third interface J3; and a gate of the four field effect tube Q5 acquires a PWM signal through a first interface J1.

Optionally, the model of the fourth field effect tube Q5 may be NMOS-LR7843.

Figure 9A:
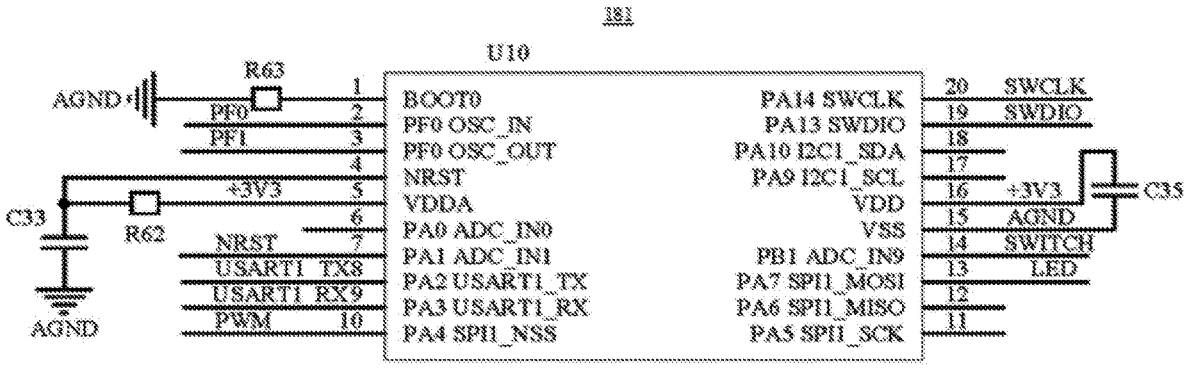
FIG. 9A is a circuit schematic diagram of a front panel circuit provided by the present disclosure.
Figure 9B:
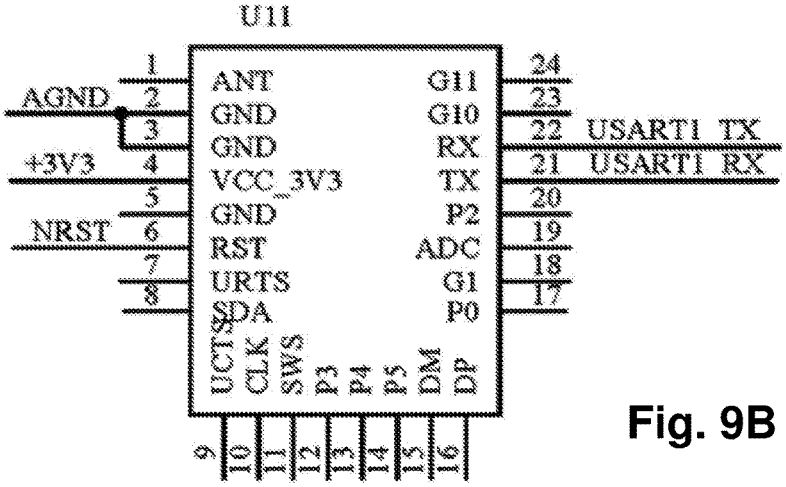
FIG. 9B is a circuit schematic diagram of a Bluetooth chip provided by the present disclosure.
Figure 9C:
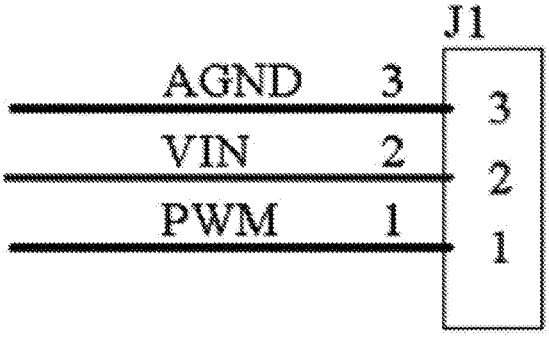
FIG. 9C is a circuit schematic diagram of a first interface provided by the present disclosure.
Figure 9F:
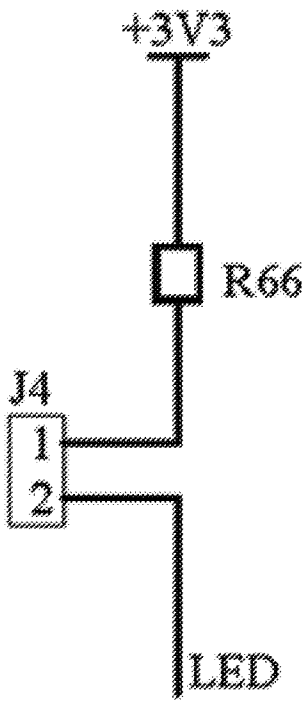
FIG. 9F is a circuit schematic diagram of a fourth interface provided by the present disclosure.
Figure 9E:
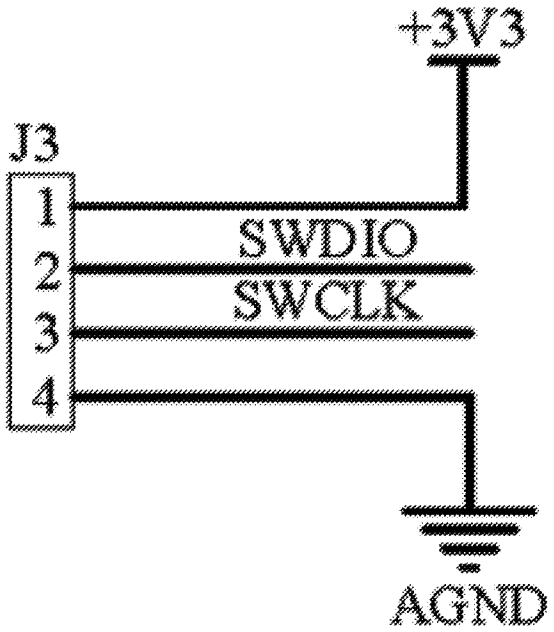
FIG. 9E is a circuit schematic diagram of a third interface provided by the present disclosure.
Figure 9D:
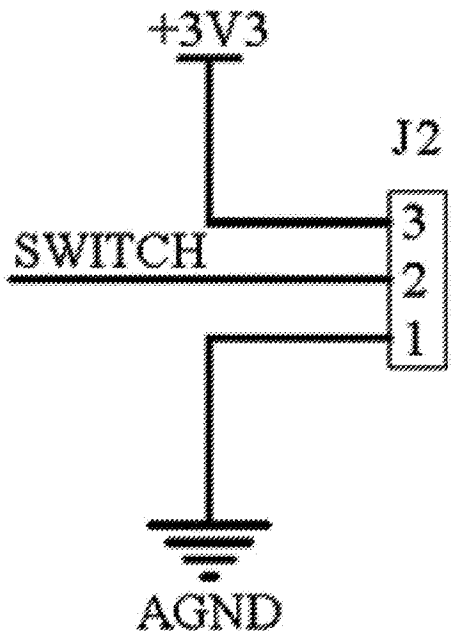
FIG. 9D is a circuit schematic diagram of a second interface provided by the present disclosure.
Figure 9G:
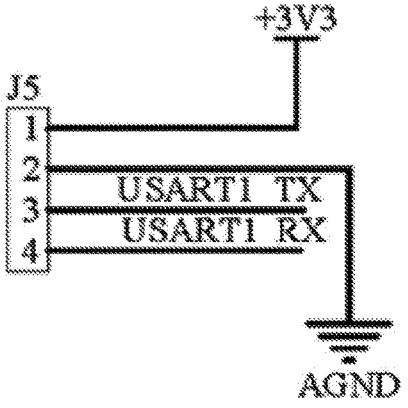
FIG. 9G is a circuit schematic diagram of a fifth interface provided by the present disclosure.

Further, the fourth field effect tube Q5 in the dimming circuit 130 shown in FIG. 8 above is able to be controlled, so as to control a display parameter of the LED load. A possible implementation of the front panel circuit is given below. The front panel circuit may control the fourth field effect tube Q5 remotely or manually. Optionally, in order to enable the remote control function, the front panel circuit is provided with a low power Bluetooth chip having the functions of the Bluetooth module and the Bluetooth control module involved in the present disclosure. In order to enable the manual input function, the front panel circuit also has an input interface, so as to connect to a plurality of different input apparatuses such as a dimming knob, a touch screen, and a voice control input apparatus, so that the user may directly control the fourth field effect tube Q5. FIG. 9A is a circuit schematic diagram of a front panel circuit provided by the present disclosure, FIG. 9B is a circuit schematic diagram of a Bluetooth chip provided by the present disclosure, FIG. 9C is a circuit schematic diagram of a first interface provided by the present disclosure, FIG. 9D is a circuit schematic diagram of a second interface provided by the present disclosure, FIG. 9E is a circuit schematic diagram of a third interface provided by the present disclosure, FIG. 9F is a circuit schematic diagram of a fourth interface provided by the present disclosure, and FIG. 9G is a circuit schematic diagram of a fifth interface provided by the present disclosure. Referring to FIGS. 9A to 9G, the front panel circuit includes: a front panel control circuit 181, a Bluetooth chip U11, a first interface J1, a second interface J2, a third interface J3, a fourth interface J4, and a fifth interface J5;

The front panel control circuit 181 includes: a sixty-third resistor R63, a sixty-fourth resistor R64 (R2), a thirty-third capacitor C33, and a thirty-fifth capacitor C35;

herein, the front panel control chip U10 is electrically connected with the first interface J1, the second interface J2, the third interface J3, the fourth interface J4, the fifth interface J5, one end of the sixty-second resistor R62, one end of the sixty-third resistor R63, one end of the thirty-third capacitor C33, the thirty-fifth capacitor C35 and the Bluetooth chip U11 respectively; the other end of the sixty-second resistor R62 and one end of the thirty-third capacitor C33; the other end of the sixty-third resistor R63 is connected with the analog ground; and the other end of the thirty-third capacitor C33 is connected with the analog ground;

specifically, a pin Vss of the front panel control chip U10 is connected with one end of the thirty-fifth capacitor C35; the other end of the thirty-fifth capacitor C35 is connected with a pin VDD of the front panel control chip U10.

The first interface J1 is respectively electrically connected with the analog ground AGND (pin 3), the voltage input end and the fourth field effect tube Q5 (pin 1) in FIG. 8, and outputs a PWM signal to the fourth field effect tube Q5;

the second interface J2 is connected with the analog ground AGND (pin 1) and a SWITCH pin of the front panel control chip U10 respectively, and the second interface J2 is connected with an input apparatus, to obtain the user's manual control signal; referring specifically to FIG. 8, the user's manual control signal obtained by the second interface J2 may control the fourth field effect tube Q5, to implement manual control of a display parameter of the LED load.

The third interface J3 is connected with the analog ground AGND, the 3.3V power supply, and the front panel control chip U10 (pin SWDIO and pin SWCLK), respectively;

specifically, the third interface J3 is used as a download interface and may be used to download a firmware update of a program or the front panel control chip U10. Referring to FIG. 8 above, herein, the third interface J3 is also connected with a drain of the fourth field effect tube Q5;

The fourth interface J4 is connected with one end of the sixty-sixth resistor R66 and the front panel control chip U10 (pin LED) respectively, and the other end of the sixty-sixth resistor R66 is connected with the 3.3V power supply;

specifically, the fourth interface J4 acts as an LED socket and is connected with the LED load.

Figure 9H:
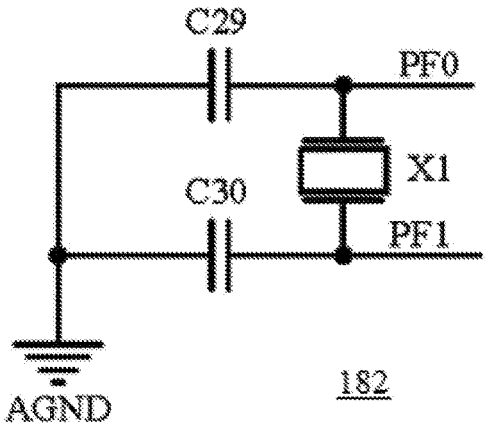
FIG. 9H is a circuit schematic diagram of a clock circuit provided by the present disclosure.
Figure 9I:
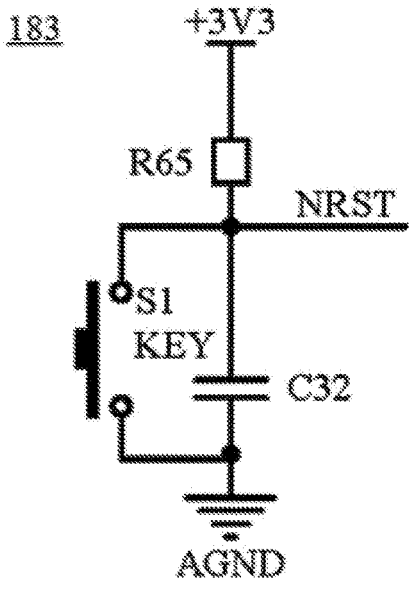
FIG. 9I is a circuit schematic diagram of a reset circuit provided by the present disclosure.
Figure 9J:
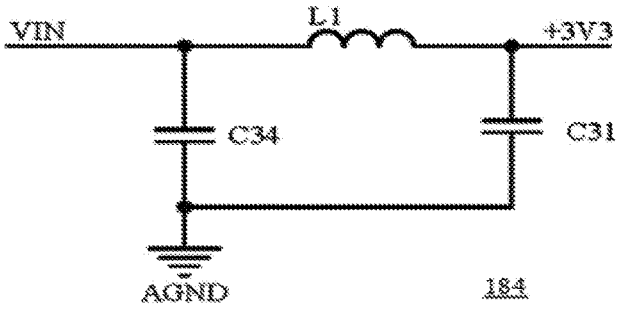
FIG. 9J is a circuit schematic diagram of a filter circuit provided by the present disclosure.

The fifth interface J5 is connected with the 3.3V power supply, the front panel control chip U10 (pin USART1_TX, pin USART1_RX) and a virtual ground AGND, respectively;

optionally, further, FIG. 9H is a circuit schematic diagram of a clock circuit provided by the present disclosure; FIG. 9I is a circuit schematic diagram of a reset circuit provided by the present disclosure; and FIG. 9J is a circuit schematic diagram of a filter circuit provided by the present disclosure, referring to FIGS. 9H to 9J, the front panel control circuit further includes: a clock circuit 182, a reset circuit 183, and a filter circuit 184;

the clock circuit 182 includes: a twenty-ninth capacitor C29 (C1), a thirtieth capacitor C30 (C3), and a first crystal oscillator X1;

one end of the first crystal oscillator X1 is connected with one end of the twenty-ninth capacitor C29 (C1) and the front panel control chip U10 (pin 2), respectively; the other end of the first crystal oscillator X1 is connected with one end of the thirtieth capacitor C30 and the front panel control chip U10 (pin 3) respectively; and the other end of the twenty-ninth capacitor C29 and the other end of the thirtieth capacitor C30 are all connected with the virtual ground AGND.

The reset circuit 183 includes: a sixty-fifth resistor R65 (R3), a first reset key S1_Key, and a thirty-second capacitor C32 (C5);

One end of the sixty-fifth resistor R65 is connected with the 3.3V power supply; the other end of the sixty-fifth resistor R65 is connected with the front panel control chip U10 (pin 7), one end of the thirty-second capacitor C32, and one end of the first reset key S1_Key respectively; and the other end of the thirty-second capacitor C32 and the other end of the first reset key S1_Key are both connected with the virtual ground AGND.

Figure 10:
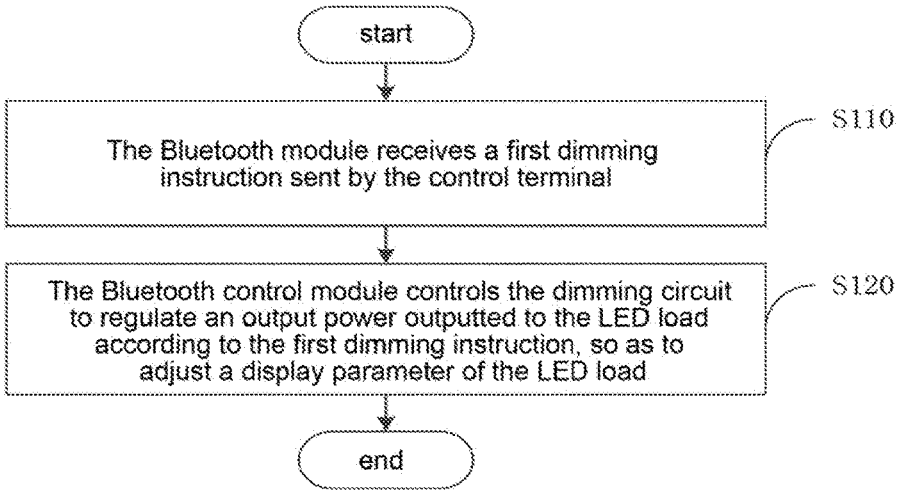
FIG. 10 is a flow chart of an LED dimming method provided by the present disclosure.

The filter circuit 184 includes: a first inductor L1, a thirty-first capacitor C31 (C4), and a thirty-fourth capacitor C34 (C8);

one end of the first inductor L1 is connected with a voltage input end and one end of the thirty-fourth capacitor C34 respectively; the other end of the first inductor L1 is connected with a 3.3V voltage and one end of the thirty-first capacitor C31 respectively; the other end of the thirty-first capacitor C31 and the other end of the thirty-fourth capacitor C34 are both connected with the virtual ground AGND. Referring to FIG. 10, FIG. 10 is a flowchart of an LED dimming method provided by the present disclosure, when applied to the above regulatable LED driver 100, the method includes the following steps:

Step S110: the Bluetooth module receives a first dimming instruction sent by the control terminal.

Step S120: the Bluetooth control module controls the dimming circuit to regulate an output power outputted to the LED load according to the first dimming instruction, so as to adjust a display parameter of the LED load.

Those skilled in the art may clearly understand that for the convenience and brevity of the description, the specific working process of the foregoing method may refer to the corresponding processes in the foregoing device, and details are not described herein again.

In summary, the present disclosure provides a regulatable LED driver and an LED dimming method, the regulatable LED driver includes a main power supply circuit, a Bluetooth module, a Bluetooth control module, and a dimming circuit, the first dimming instruction sent by the control terminal is received through the Bluetooth module, the Bluetooth control module controls the dimming circuit to regulate an output power outputted to the LED load according to the first dimming instruction, so as to adjust a display parameter of the LED load, so that the regulatable LED driver may be controlled by the control terminal remotely, enabling the flexible adjustment of the parameters of the LED load, and improving the convenience of adjusting a display parameter of the LED load.

Figure 11:
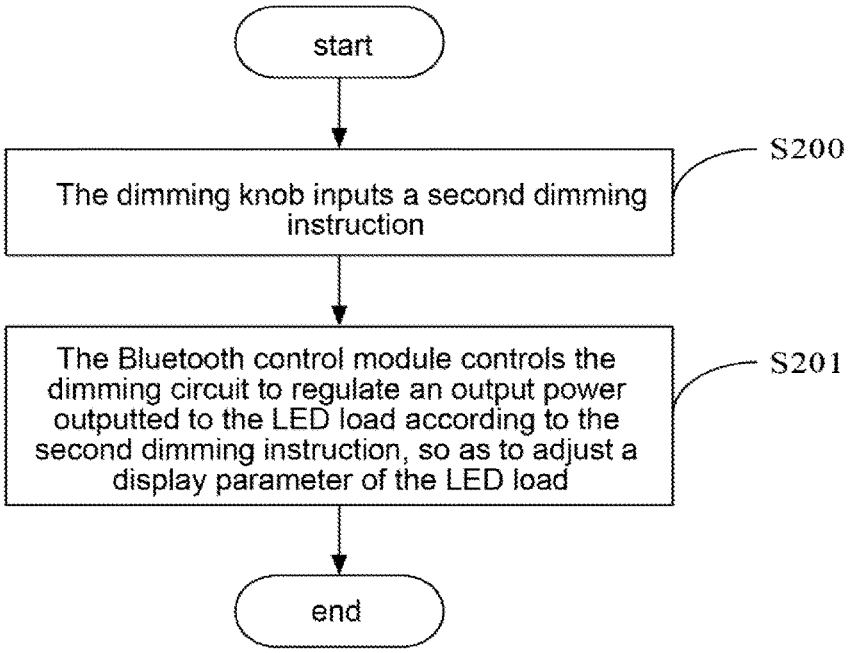
FIG. 11 is a flow chart of another LED dimming method provided by the present disclosure.

Referring to FIG. 11, FIG. 11 is a flowchart of another LED dimming method provided by the present disclosure, when applied to the above adjustable LED driver 100, furthering including the dimming knob, the method includes the following steps:

Step S200: the dimming knob inputs a second dimming instruction;

Step S201: the Bluetooth control module controls the dimming circuit to regulate an output power outputted to the LED load according to the second dimming instruction, so as to adjust a display parameter of the LED load.

The present disclosure provides a regulatable LED driver and an LED dimming method, the regulatable LED driver includes a main power supply circuit, a Bluetooth module, a Bluetooth control module, and a dimming circuit, a second dimming instruction is inputted by the dimming knob, the Bluetooth control module controls the dimming circuit to regulate an output power outputted to the LED load according to the second dimming instruction, so as to adjust a display parameter of the LED load, so that the regulatable LED driver may be controlled by the user manually, enabling the flexible adjustment of the parameters of the LED load, and improving the convenience of adjusting a display parameter of the LED load.

It should be indicated that the procedure flow shown in FIG. 10 and the procedure flow shown in FIG. 11 may be performed simultaneously or independently, and are not limited herein.

Figure 12:
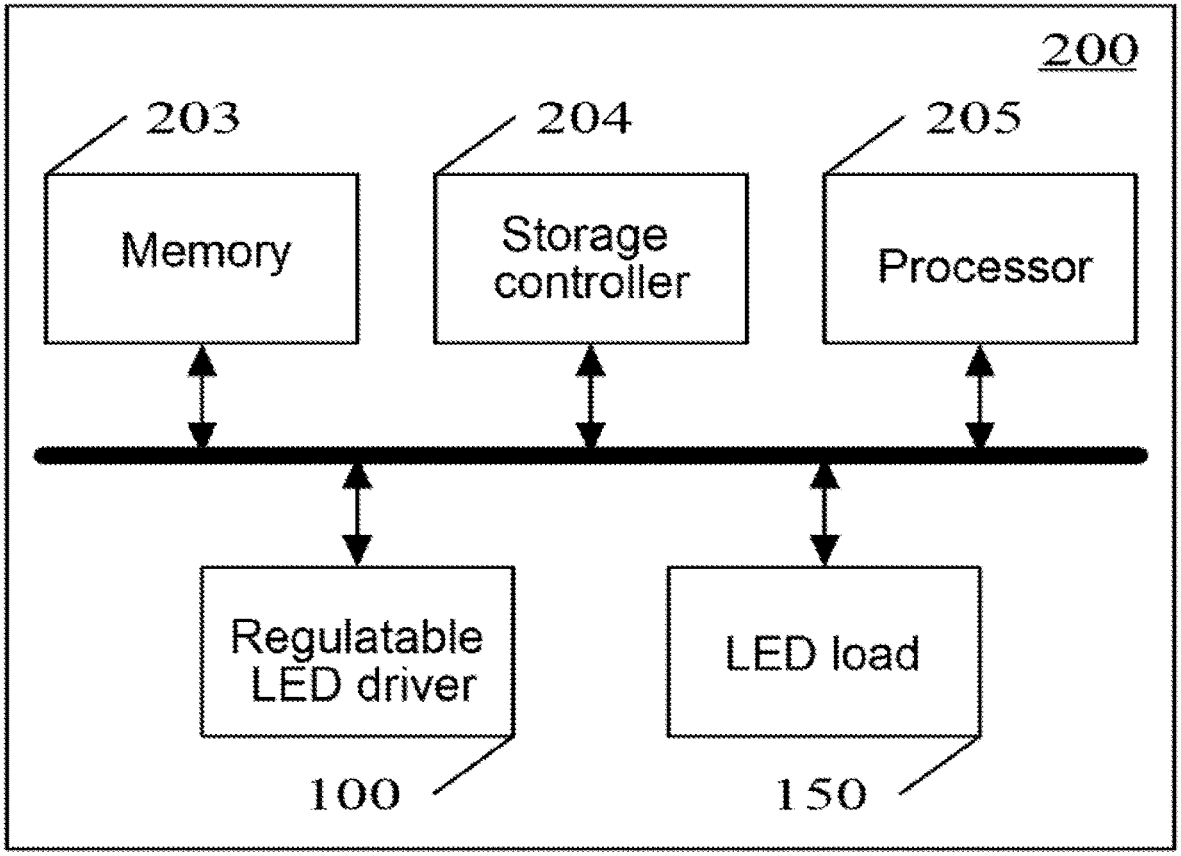
FIG. 12 is a schematic diagram of an electronic apparatus provided by the present disclosure.

Optionally, FIG. 12 is a schematic diagram of an electronic apparatus provided by the present disclosure; and referring to FIG. 12, it provides a possible implementation of an electronic apparatus. The electronic apparatus 200 is capable of performing corresponding steps of the LED dimming method described above to achieve the corresponding technical effects. The electronic apparatus 200 may be, but is not limited to, a smart phone, a personal computer (PC), a tablet computer, a personal digital assistant (PDA), a mobile internet device (MID), a smart home apparatus, a smart illumination apparatus, and so on. The electronic apparatus 200 may include a regulatable LED driver 100, an LED load 150, a memory 203, a storage controller 204, and a processor 205.

Various elements, the memory 203, the storage controller 204, and the processor 205 are electrically connected directly or indirectly to each other to implement data transmission or interaction. For example, these elements may be electrically connected with one another via one or more communication buses or signal lines. The regulatable LED driver 201 may include at least one software function module that may be stored in the memory 203 in the form of software or firmware or solidified in an operating system (OS) of the electronic apparatus 200. The processor 205 is configured to execute an executable module stored in the memory 203, for example, a software function module and a computer program etc. required to control the regulatable LED driver 100, thereby controlling the technical indexes such as a brightness, a color temperature, and a color of the LED load 150 through the regulatable LED driver 100. Of course, such control may be performed manually by the user based on the OS of the electronic apparatus 200, or remotely controlled by other control terminals based on the wireless communication method.

Herein, the memory 203 may be, but is not limited to, a random access memory (RAM), a read only memory (ROM), a programmable read-only memory PROM), an erasable programmable read-only memory (EPROM), an electric erasable programmable read-only memory (EEPROM), etc. Herein, the memory 203 is configured to store the program, and the processor 205 executes the program after receiving the execution instruction. The access of the processor 113 and other possible components to memory 203 may be performed under the control of the storage controller 204.

The processor 205 may be an integrated circuit chip with signal processing capabilities. The above processor 205 may be a general purpose processor, including a central processing unit (CPU), a network processor (NP), and the like; or may be a digital signal processor (DSP), an application specific integrated circuit (ASIC), or an field programmable gate array (FPGA) or other programmable logic device, discrete gate or transistor logic device, a discrete hardware component. Various methods, steps, and logical block diagrams disclosed in the present disclosure may be implemented or executed. The general purpose processor may be a microprocessor or the processor may be any conventional processor or the like.

It should be understood that the structure shown in FIG. 12 is only a schematic structural view of the electronic apparatus 200, the electronic apparatus 200 may further include more or less components than those shown in FIG. 12, or have a different configuration from what shown in FIG. 12. Various components shown in FIG. 12 may be implemented in hardware, software, or a combination thereof.

INDUSTRIAL APPLICABILITY

The present disclosure provides an LED dimming method, a regulatable LED driver, an electronic apparatus and a readable storage medium, adding the modes of adjusting a display parameter of the LED load and improving the product performance.

Having now fully described the present invention in some detail by way of illustration and examples for purposes of clarity of understanding, it will be obvious to one of ordinary skill in the art that the same can be performed by modifying or changing the invention within a wide and equivalent range of conditions, formulations and other parameters without affecting the scope of the invention or any specific embodiment thereof, and that such modifications or changes are intended to be encompassed within the scope of the appended claims.

When a group of materials, compositions, components or compounds is disclosed herein, it is understood that all individual members of those groups and all subgroups thereof are disclosed separately. Every formulation or combination of components described or exemplified herein can be used to practice the invention, unless otherwise stated. Whenever a range is given in the specification, for example, a temperature range, a time range, or a composition range, all intermediate ranges and subranges, as well as all individual values included in the ranges given are intended to be included in the disclosure. Additionally, the end points in a given range are to be included within the range. In the disclosure and the claims, "and/or" means additionally or alternatively. Moreover, any use of a term in the singular also encompasses plural forms.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements.

One of ordinary skill in the art will appreciate that starting materials, device elements, analytical methods, mixtures and combinations of components other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. The invention illustratively described herein suitably may be practiced in the absence of any element or elements, limitation or limitations which is not specifically disclosed herein. Headings are used herein for convenience only.

All publications referred to herein are incorporated herein to the extent not inconsistent herewith. Some references provided herein are incorporated by reference to provide details of additional uses of the invention. All patents and publications mentioned in the specification are indicative of the levels of skill of those skilled in the art to which the invention pertains. References cited herein are incorporated by reference herein in their entirety to indicate the state of the art as of their filing date and it is intended that this information can be employed herein, if needed, to exclude specific embodiments that are in the prior art.

The invention claimed is:

1. A regulatable LED driver, comprising: a main power supply circuit, a Bluetooth module, a Bluetooth control module, and a dimming circuit, the main power supply circuit is connected with the dimming circuit, the dimming circuit is configured to be connected with the LED load, the Bluetooth module is connected with the Bluetooth control module, the Bluetooth control module is connected with the dimming circuit, and the Bluetooth module is configured to be connected with a control terminal;

the Bluetooth module is configured to receive a first dimming instruction sent by the control terminal; and the Bluetooth control module is configured to control the dimming circuit to regulate an output power outputted to the LED load according to the first dimming instruction, so as to adjust a display parameter of the LED load, wherein the regulatable LED driver further comprises a dimming knob;

the dimming knob is configured to input a second dimming instruction; and the Bluetooth control module is further configured to control the dimming circuit to regulate an output power outputted to the LED load according to the second dimming instruction, so as to adjust a display parameter of the LED load, wherein the regulatable LED driver further comprises a pre-stage PFC circuit, the pre-stage PFC circuit is connected with an input power supply, the pre-stage PFC circuit is connected with the main power supply circuit, and the main power supply circuit is connected with the dimming circuit, wherein the main power supply circuit comprises an optically coupling circuit, a switch power supply control circuit, a transformer and a voltage regulating circuit, the optically coupling circuit is connected with the switch power supply control circuit and the dimming circuit, respectively, the switch power supply control circuit is connected with the pre-stage PFC circuit, the switch power supply control circuit is connected with the transformer, the transformer is connected with the voltage regulating circuit, and the voltage regulating circuit is connected with the dimming circuit, wherein the optically coupling circuit comprises an optical coupler, a first capacitor, a second capacitor, a first resistor, a second resistor, a third resistor, a fourth resistor, a fifth resistor and a first diode, an output end of the optical coupler is connected with the main power supply circuit, an input end of the optical coupler is connected with one end of the first capacitor, the input end of the optical coupler is also connected with a cathode of the first diode, and the other end of the first capacitor is connected with the main power supply circuit, one end of the first capacitor is connected with one end of the first resistor, and the other end of the first resistor is connected with the main power supply circuit, the cathode of the first diode is connected with one end of the second resistor and one end of the second capacitor, an anode of the first diode is grounded, and the other end of the second resistor is connected with one end of the third resistor and the main power supply circuit, the other end of the third resistor is connected with the other end of the second capacitor and one end of the fourth resistor, one end of the fourth resistor is connected with the first diode, the other end of the fourth resistor is grounded, one end of the fourth resistor is also connected with one end of the fifth resistor, and the other end of the fifth resistor is grounded.

2. The regulatable LED driver according to claim 1, wherein the switch power supply control circuit comprises a sixth resistor, a seventh resistor, an eighth resistor, a ninth resistor, a tenth resistor, an eleventh resistor, a twelfth resistor, a thirteenth resistor, a second diode, a third diode, a fourth diode, a fifth diode, a sixth diode, a seventh diode, an eighth diode, a third capacitor, a fourth capacitor, a fifth capacitor, a sixth capacitor, a seventh capacitor, an eighth capacitor, a ninth capacitor, a tenth capacitor, a first field effect tube, a second field effect tube, a first triode and a switch power supply chip, one end of the sixth resistor is connected with the pre-stage PFC circuit, the other end of the sixth resistor is connected with the switch power supply chip and one end of the seventh resistor, one end of the eighth resistor and one end of the ninth resistor are connected with the pre-stage PFC circuit, the other end of the eighth resistor and the other end of the ninth resistor are connected with an anode of the third diode, an anode of the second diode is connected with one end of the third capacitor, and the other end of the third capacitor is grounded, one end of the tenth resistor, one end of the eleventh resistor and one end of the twelfth resistor are connected with the switch power supply chip, and the other end of the tenth resistor is grounded, and the other end of the eleventh resistor is connected with the pre-stage PFC circuit, the other end of the twelfth resistor is connected with one end of the fourth capacitor, the other end of the fourth capacitor is grounded, and a cathode of the second diode is connected with one end of the fifth capacitor, the other end of the fifth capacitor is connected with the switch power supply chip, a gate of the first field effect tube is connected with the switch power supply chip, a source of the first field effect tube is connected with the switch power supply chip, a drain of the first field effect tube is connected with the pre-stage PFC circuit, a gate of the second field effect tube is connected with a locked switch power supply chip, a drain of the second field effect tube is connected with the switch power supply chip, a source of the second field effect tube is grounded, one end of the sixth capacitor is connected with the pre-stage PFC circuit, the other end of the sixth capacitor is connected with one end of the seventh capacitor, and the other end of the seventh capacitor is grounded, a cathode of the third diode is connected with the pre-stage PFC circuit, an anode of the third diode is connected with the transformer and a cathode of the fourth diode, an anode of the fourth diode is grounded, a cathode of the fifth diode and a cathode of the sixth diode are all connected with one end of the eighth capacitor, one end of the ninth capacitor is connected with the anode of the fourth diode, the other end of the ninth capacitor is grounded, one end of the thirteenth resistor is connected with one end of the eighth capacitor, a base of the first triode is connected with a cathode of the seventh diode, an emitter of the first triode is connected with an anode of the eighth diode, a cathode of the eighth diode is connected with the switch power supply chip, a cathode of the eighth diode is connected with one end of the tenth capacitor, the other end of the tenth capacitor is grounded, an anode of the seventh diode is grounded, and the other end of the eighth capacitor is grounded.

3. The regulatable LED driver according to claim 2, wherein a primary side coil of the transformer is connected with the switch power supply control circuit, and a secondary side coil of the transformer is connected with the dimming circuit.

4. The regulatable LED driver according to claim 3, wherein the voltage regulating circuit comprises a micro control chip, a buck chip, a power supply chip, a fourteenth resistor, a fifteenth resistor, a sixteenth resistor, an eleventh capacitor, a twelfth capacitor, and a thirteenth capacitor, a fourteenth capacitor and a ninth diode, the micro control chip is connected with a secondary side coil of the transformer, the micro control chip is connected with the dimming circuit, an anode of the ninth diode is connected with the secondary side coil of the transformer, a cathode of the ninth diode is connected with the buck chip, a cathode of the ninth diode is also connected with one end of the eleventh capacitor, and the other end of the eleventh capacitor is connected with the secondary side coil of the transformer, one end of the fourteenth resistor is connected with the secondary side coil of the transformer, the other end of the fourteenth resistor is connected with one end of the fifteenth resistor, and the other end of the fifteenth resistor is grounded, one end of the twelfth capacitor is connected with the power supply chip, the other end of the twelfth capacitor is grounded, one end of the thirteenth capacitor is connected with the buck chip, the other end of the thirteenth capacitor is connected with the secondary coil side of the transformer, one end of the sixteenth resistor is connected with the micro controller chip, the other end of the sixteenth resistor is connected with one end of the fourteenth capacitor, and the other end of the fourteenth capacitor is grounded.

5. The regulatable LED driver according to claim 4, wherein the dimming circuit is a post-polarization dimming chopper circuit, the post-polarization dimming chopper circuit comprises a fifteenth capacitor, a sixteenth capacitor, a seventeenth resistor, an eighteenth resistor, a nineteenth resistor, and a third field effect tube, one end of the fifteenth capacitor, one end of the sixteenth capacitor, one end of the seventeenth resistor, one end of the eighteenth resistor, and one end of the nineteenth resistor are all connected with the micro control chip, the other end of the fifteenth capacitor, the other end of the sixteenth capacitor, the other end of the seventeenth resistor, the other end of the eighteenth resistor, and the other end of the nineteenth resistor are all grounded, a source of the third field effect tube is grounded, a gate of the third field effect tube is connected with the LED load, and a drain of the third field effect tube is connected with the optically coupling circuit.

6. The regulatable LED driver according to claim 1, wherein the switch power supply control circuit comprises: a thirty-ninth resistor, a fortieth resistor, a forty-first Resistor, a forty-second resistor, a forty-third resistor, a forty-fifth resistor, a forty-sixth resistor, a forty-seventh resistor, a forty-eighth resistor, a forty-ninth resistor, a fiftieth resistor, a fifty-first resistor, a fifty-second resistor, a fifty-third resistor, a fifty-fourth resistor, a fifty-fifth resistor, a fifty-seventh resistor, a power supply management chip, a nineteenth capacitor, a twenty-second capacitor, a twenty-third polarity capacitor, a twenty-fourth capacitor, a twenty-fifth capacitor, a twenty-sixth capacitor, a twenty-seventh capacitor, a twelfth diode, a fourteenth diode, a fifteenth diode, a second triode, and a fifth field effect tube;

wherein one end of the thirty-ninth resistor, one end of the fortieth resistor, and one end of the nineteenth capacitor are all connected with the pre-stage PFC circuit and one end of the primary coil in the transformer, the other end the thirty-ninth resistor, the other end of the fortieth resistor, and the other end of the nineteenth capacitor are all connected with a negative electrode of the twelfth diode; a positive electrode of the twelfth diode is connected with the other end of a primary coil of the transformer and a drain of the fifth field effect tube respectively; a source of the fifth field effect tube is connected with one end of the fifty-first resistor, one end of the fifty-second resistor, one end of the fifty-third resistor, one end of the fifty-fourth resistor and one end of the fifty-fifth resistor respectively; a gate of the fifth field effect tube is connected with a positive electrode of the fifteenth diode, one end of the forty-seventh resistor and one end of the forty-ninth resistor respectively; the other end of the forty-ninth resistor is connected with one end of the fifty-first resistor and a source of the fifth field effect tube respectively; a negative electrode of the fifteenth diode is connected with one end of the forty-fifth resistor; the other end of the forty-fifth resistor is connected with the power supply management chip and the other end of the forty-seventh resistor respectively; and the other end of the fifty-second resistor, the other end of the fifty-third resistor, the other end of the fifty-fourth resistor, and the other end of the fifty-fifth resistor are all grounded;

the other end of the fifty-first resistor is connected with one end of the twenty-seventh capacitor, the power supply management chip, and one end of the forty-sixth resistor respectively; the other end of the twenty-seventh capacitor is grounded; the other end of the forty-sixth resistor is connected with an emitter of a second triode; a base of the second triode is connected with one end of the twenty-fifth capacitor and one end of the fiftieth resistor respectively; a collector of the second triode is connected with the power supply management chip, one end of the twenty-second capacitor and the optical coupler, respectively; the other end of the twenty-fifth capacitor is grounded; the other end of the twenty-second capacitor is grounded; and the other end of the fiftieth resistor is connected with the optical coupler;

one end of the twenty-sixth capacitor and one end of the forty-eighth resistor each are connected with the power supply management chip and one end of the fifty-seventh resistor respectively; the other end of the twenty-sixth capacitor and the other end of the forty-eighth resistor are all connected with the power supply management chip; the other end of the fifty-seventh resistor is connected with the optical coupler and one end of the fifty-eighth resistor, respectively; and the other end of the fifty-eighth resistor is grounded;

one end of an induction coil in the transformer is grounded; the other end of the induction coil in the transformer is connected with a positive electrode of the fourteenth diode; a negative electrode of the fourteenth diode is connected with one end of the forty-third resistor; the other end of the forty-third resistor is connected with a positive electrode of the twenty-third polarity capacitor, one end of the twenty-fourth capacitor, one end of the forty-second resistor, and the power supply management chip, respectively; a negative electrode of the twenty-third polarity capacitor and the other end of the twenty-fourth capacitor are respectively grounded; the other end of the forty-second resistor is connected with one end of the forty-first resistor; and the other end of the forty-first resistor is connected with one end of the thirty-ninth resistor and the pre-stage PFC circuit, respectively;

the optically coupling circuit comprises: a forty-fourth resistor, a fifty-sixth resistor, a fifty-eighth resistor, a fifty-ninth resistor, a sixtieth resistor, an optical coupler, a twenty-eighth capacitor, and the voltage regulating tube;

wherein one end of the fifty-sixth resistor is connected with the optical coupler; the optical coupler is connected with a cathode of the voltage regulating tube and one end of the twenty-eighth capacitor respectively; an anode of the voltage regulating tube is connected with one end of the fifty-ninth resistor, one end of the sixtieth resistor, and an analog ground respectively; the other end of the fifty-ninth resistor and the other end of the sixtieth resistor are connected with a reference electrode of the voltage regulating tube, the other end of the twenty-eighth capacitor, and one end of the forty-fourth resistor respectively; the optical coupler is connected with the other end of the fifty-seventh resistor and one end of the fifty-eighth resistor respectively; and the optical coupler is connected with the other end of the fiftieth resistor; and the other end of the fifty-eighth resistor is grounded;

the dimming circuit comprises: a sixty-first resistor, a sixty-second resistor, a seventeenth polarity capacitor, an eighteenth polarity capacitor, a tenth diode, an eleventh diode, and a fourth field effect tube;

wherein one end of a first secondary coil in the transformer is connected with a negative electrode of the seventeenth polarity capacitor, a negative electrode of the eighteenth polarity capacitor, one end of the sixty-first resistor, one end of the sixty-second resistor, an analog ground and a source of the fourth field effect tube respectively; a positive electrode of the seventeenth polarity capacitor, a positive electrode of the eighteenth polarity capacitor, the other end of the sixty-first resistor and the other end of the sixty-second resistors are connected with a negative electrode of the tenth diode, a negative electrode of the eleventh diode, one end of the fifty-sixth resistor, one end of the forty-fourth resistor, and a second interface, respectively; a positive electrode of the tenth diode and a positive electrode of the eleventh diode are both connected with the other end of the first secondary coil in the transformer; a drain of the fourth field effect tube is connected with a third interface; and a gate of the four field effect tube is connected with a PWM circuit;

the voltage regulating circuit comprises: a thirteenth diode, a twentieth polarity capacitor, a twenty-first capacitor, and a buck chip; and wherein one end of a second secondary coil in the transformer is connected with a negative electrode of the twentieth polarity capacitor, the buck chip, one end of the twenty-first capacitor, and a protective ground respectively; the other end of the second secondary coil in the transformer is connected with a positive electrode of the thirteenth diode; a negative electrode of the thirteenth diode is connected with a positive electrode of the twentieth polarity capacitor and the buck chip, respectively; and the buck chip is connected with the other end of the twenty-first capacitor.

7. The regulatable LED driver according to claim 1, further comprising a front panel circuit, wherein the front panel circuit comprises: a front panel control circuit, a Bluetooth chip, a first interface, a second interface, a third interface, a fourth interface, and a fifth interface; and the front panel control circuit comprises: a sixty-third resistor, a sixty-fourth resistor, a thirty-third capacitor, and a thirty-fifth capacitor, wherein the front panel control chip is electrically connected with the first interface, the second interface, the third interface, the fourth interface, the fifth interface, one end of the sixty-second resistor, one end of the sixty-third resistor, one end of the thirty-third capacitor, the thirty-fifth capacitor and the Bluetooth chip respectively; the other end of the sixty-second resistor and one end of the thirty-third capacitor; and the other end of the sixty-third resistor is connected with an analog ground; and the other end of the thirty-third capacitor is connected with the analog ground;

the first interface is respectively electrically connected with the analog ground, an voltage input end and the fourth field effect tube, and outputs a PWM signal to the fourth field effect tube;

the second interface is connected with the analog ground and the front panel control chip respectively, and the second interface is connected with an input apparatus to obtain a user's manual control signal;

the third interface is connected with the analog ground, a power supply, and the front panel control chip respectively;

the fourth interface is connected with one end of the sixty-sixth resistor and the front panel control chip respectively, and the other end of the sixty-sixth resistor is connected with the power supply;

the fifth interface is connected with the power supply, the front panel control chip and a virtual ground respectively;

the front panel control circuit further comprises: a clock circuit, a reset circuit, and a filtering circuit;

the clock circuit comprises: a twenty-ninth capacitor, a thirtieth capacitor, and a first crystal oscillator;

one end of the first crystal oscillator is connected with one end of the twenty-ninth capacitor and the front panel control chip respectively; the other end of the first crystal oscillator is connected with one end of the thirtieth capacitor and the front panel control chip respectively; and the other end of the twenty-ninth capacitor and the other end of the thirtieth capacitor are all connected with the virtual ground;

the reset circuit comprises: a sixty-fifth resistor, a first reset key, and a thirty-second capacitor;

one end of the sixty-fifth resistor is connected with the power supply; the other end of the sixty-fifth resistor is connected with the front panel control chip, one end of the thirty-second capacitor, and one end of the first reset key respectively; and the other end of the thirty-second capacitor and the other end of the first reset key are both connected with the virtual ground;

the filter circuit comprises: a first inductor, a thirty-first capacitor, and a thirty-fourth capacitor; and one end of the first inductor is connected with a voltage input end and one end of the thirty-fourth capacitor respectively; the other end of the first inductor is connected with a power supply and one end of the thirty-first capacitor respectively; and the other end of the thirty-first capacitor and the other end of the thirty-fourth capacitor are both connected with the virtual ground.

8. An LED dimming method, applied to the regulatable LED driver according to claim 1, wherein the regulatable LED driver comprises: a main power supply circuit, a Bluetooth module, a Bluetooth control module, and a dimming circuit, the main power supply circuit is connected with the dimming circuit, the dimming circuit is configured to be connected with the LED load, the Bluetooth module is connected with the Bluetooth control module, the Bluetooth control module is connected with the dimming circuit, and the Bluetooth module is configured to be connected with a control terminal; the method comprising:

the Bluetooth module receiving a first dimming instruction sent by the control terminal; and the Bluetooth control module controlling the dimming circuit to regulate an output power outputted to the LED load according to the first dimming instruction, so as to adjust a display parameter of the LED load.

9. The LED dimming method according to claim 8, wherein the Bluetooth control module comprises a dimming knob, the method further comprising:

the dimming knob inputting a second dimming instruction; and the Bluetooth control module controlling the dimming circuit to regulate an output power outputted to the LED load according to the second dimming instruction, so as to adjust a display parameter of the LED load.

10. An electronic apparatus comprising a processor and a non-volatile memory storing a plurality of computer instructions, wherein when the computer instructions are executed by the processor, the electronic apparatus executes the LED dimming method according to claim 8.

11. The electronic apparatus according to claim 10, wherein the Bluetooth control module comprises a dimming knob, the electronic apparatus further comprising:

the dimming knob inputting a second dimming instruction; and the Bluetooth control module controlling the dimming circuit to regulate an output power outputted to the LED load according to the second dimming instruction, so as to adjust a display parameter of the LED load.

12. The LED dimming method according to claim 8, wherein the regulatable LED driver further comprises a pre-stage PFC circuit, the pre-stage PFC circuit is connected with an input power supply, the pre-stage PFC circuit is connected with the main power supply circuit, and the main power supply circuit is connected with the dimming circuit.

13. The LED dimming method according to claim 12, wherein the main power supply circuit comprises an optically coupling circuit, a switch power supply control circuit, a transformer and a voltage regulating circuit, the optically coupling circuit is connected with the switch power supply control circuit and the dimming circuit, respectively, the switch power supply control circuit is connected with the pre-stage PFC circuit, the switch power supply control circuit is connected with the transformer, the transformer is connected with the voltage regulating circuit, and the voltage regulating circuit is connected with the dimming circuit.

14. The LED dimming method according to claim 13, wherein the optically coupling circuit comprises an optical coupler, a first capacitor, a second capacitor, a first resistor, a second resistor, a third resistor, a fourth resistor, a fifth resistor and a first diode, an output end of the optical coupler is connected with the main power supply circuit, an input end of the optical coupler is connected with one end of the first capacitor, the input end of the optical coupler is also connected with a cathode of the first diode, and the other end of the first capacitor is connected with the main power supply circuit, one end of the first capacitor is connected with one end of the first resistor, and the other end of the first resistor is connected with the main power supply circuit, the cathode of the first diode is connected with one end of the second resistor and one end of the second capacitor, an anode of the first diode is grounded, and the other end of the second resistor is connected with one end of the third resistor and the main power supply circuit, the other end of the third resistor is connected with the other end of the second capacitor and one end of the fourth resistor, one end of the fourth resistor is connected with the first diode, the other end of the fourth resistor is grounded, one end of the fourth resistor is also connected with one end of the fifth resistor, and the other end of the fifth resistor is grounded.

15. The LED dimming method according to claim 14, wherein the switch power supply control circuit comprises a sixth resistor, a seventh resistor, an eighth resistor, a ninth resistor, a tenth resistor, an eleventh resistor, a twelfth resistor, a thirteenth resistor, a second diode, a third diode, a fourth diode, a fifth diode, a sixth diode, a seventh diode, an eighth diode, a third capacitor, a fourth capacitor, a fifth capacitor, a sixth capacitor, a seventh capacitor, an eighth capacitor, a ninth capacitor, a tenth capacitor, a first field effect tube, a second field effect tube, a first triode and a switch power supply chip, one end of the sixth resistor is connected with the pre-stage PFC circuit, the other end of the sixth resistor is connected with the switch power supply chip and one end of the seventh resistor, one end of the eighth resistor and one end of the ninth resistor are connected with the pre-stage PFC circuit, the other end of the eighth resistor and the other end of the ninth resistor are connected with an anode of the third diode, an anode of the second diode is connected with one end of the third capacitor, and the other end of the third capacitor is grounded, one end of the tenth resistor, one end of the eleventh resistor and one end of the twelfth resistor are connected with the switch power supply chip, and the other end of the tenth resistor is grounded, and the other end of the eleventh resistor is connected with the pre-stage PFC circuit, the other end of the twelfth resistor is connected with one end of the fourth capacitor, the other end of the fourth capacitor is grounded, and a cathode of the second diode is connected with one end of the fifth capacitor, the other end of the fifth capacitor is connected with the switch power supply chip, a gate of the first field effect tube is connected with the switch power supply chip, a source of the first field effect tube is connected with the switch power supply chip, a drain of the first field effect tube is connected with the pre-stage PFC circuit, a gate of the second field effect tube is connected with a locked switch power supply chip, a drain of the second field effect tube is connected with the switch power supply chip, a source of the second field effect tube is grounded, one end of the sixth capacitor is connected with the pre-stage PFC circuit, the other end of the sixth capacitor is connected with one end of the seventh capacitor, and the other end of the seventh capacitor is grounded, a cathode of the third diode is connected with the pre-stage PFC circuit, an anode of the third diode is connected with the transformer and a cathode of the fourth diode, an anode of the fourth diode is grounded, a cathode of the fifth diode and a cathode of the sixth diode are all connected with one end of the eighth capacitor, one end of the ninth capacitor is connected with the anode of the fourth diode, the other end of the ninth capacitor is grounded, one end of the thirteenth resistor is connected with one end of the eighth capacitor, a base of the first triode is connected with a cathode of the seventh diode, an emitter of the first triode is connected with an anode of the eighth diode, a cathode of the eighth diode is connected with the switch power supply chip, a cathode of the eighth diode is connected with one end of the tenth capacitor, the other end of the tenth capacitor is grounded, an anode of the seventh diode is grounded, and the other end of the eighth capacitor is grounded.

16. The LED dimming method according to claim 13, wherein the switch power supply control circuit comprises: a thirty-ninth resistor, a fortieth resistor, a forty-first Resistor, a forty-second resistor, a forty-third resistor, a forty-fifth resistor, a forty-sixth resistor, a forty-seventh resistor, a forty-eighth resistor, a forty-ninth resistor, a fiftieth resistor, a fifty-first resistor, a fifty-second resistor, a fifty-third resistor, a fifty-fourth resistor, a fifty-fifth resistor, a fifty-seventh resistor, a power supply management chip, a nineteenth capacitor, a twenty-second capacitor, a twenty-third polarity capacitor, a twenty-fourth capacitor, a twenty-fifth capacitor, a twenty-sixth capacitor, a twenty-seventh capacitor, a twelfth diode, a fourteenth diode, a fifteenth diode, a second triode, and a fifth field effect tube;

wherein one end of the thirty-ninth resistor, one end of the fortieth resistor, and one end of the nineteenth capacitor are all connected with the pre-stage PFC circuit and one end of the primary coil in the transformer, the other end the thirty-ninth resistor, the other end of the fortieth resistor, and the other end of the nineteenth capacitor are all connected with a negative electrode of the twelfth diode; a positive electrode of the twelfth diode is connected with the other end of a primary coil of the transformer and a drain of the fifth field effect tube respectively; a source of the fifth field effect tube is connected with one end of the fifty-first resistor, one end of the fifty-second resistor, one end of the fifty-third resistor, one end of the fifty-fourth resistor and one end of the fifty-fifth resistor respectively; a gate of the fifth field effect tube is connected with a positive electrode of the fifteenth diode, one end of the forty-seventh resistor and one end of the forty-ninth resistor respectively; the other end of the forty-ninth resistor is connected with one end of the fifty-first resistor and a source of the fifth field effect tube respectively; a negative electrode of the fifteenth diode is connected with one end of the forty-fifth resistor; the other end of the forty-fifth resistor is connected with the power supply management chip and the other end of the forty-seventh resistor respectively; and the other end of the fifty-second resistor, the other end of the fifty-third resistor, the other end of the fifty-fourth resistor, and the other end of the fifty-fifth resistor are all grounded;

the other end of the fifty-first resistor is connected with one end of the twenty-seventh capacitor, the power supply management chip, and one end of the forty-sixth resistor respectively; the other end of the twenty-seventh capacitor is grounded; the other end of the forty-sixth resistor is connected with an emitter of a second triode; a base of the second triode is connected with one end of the twenty-fifth capacitor and one end of the fiftieth resistor respectively; a collector of the second triode is connected with the power supply management chip, one end of the twenty-second capacitor and the optical coupler, respectively; the other end of the twenty-fifth capacitor is grounded; the other end of the twenty-second capacitor is grounded; and the other end of the fiftieth resistor is connected with the optical coupler;

one end of the twenty-sixth capacitor and one end of the forty-eighth resistor each are connected with the power supply management chip and one end of the fifty-seventh resistor respectively; the other end of the twenty-sixth capacitor and the other end of the forty-eighth resistor are all connected with the power supply management chip; the other end of the fifty-seventh resistor is connected with the optical coupler and one end of the fifty-eighth resistor, respectively; and the other end of the fifty-eighth resistor is grounded;

one end of an induction coil in the transformer is grounded; the other end of the induction coil in the transformer is connected with a positive electrode of the fourteenth diode; a negative electrode of the fourteenth diode is connected with one end of the forty-third resistor; the other end of the forty-third resistor is connected with a positive electrode of the twenty-third polarity capacitor, one end of the twenty-fourth capacitor, one end of the forty-second resistor, and the power supply management chip, respectively; a negative electrode of the twenty-third polarity capacitor and the other end of the twenty-fourth capacitor are respectively grounded; the other end of the forty-second resistor is connected with one end of the forty-first resistor; and the other end of the forty-first resistor is connected with one end of the thirty-ninth resistor and the pre-stage PFC circuit, respectively;

the optically coupling circuit comprises: a forty-fourth resistor, a fifty-sixth resistor, a fifty-eighth resistor, a fifty-ninth resistor, a sixtieth resistor, an optical coupler, a twenty-eighth capacitor, and the voltage regulating tube;

wherein one end of the fifty-sixth resistor is connected with the optical coupler; the optical coupler is connected with a cathode of the voltage regulating tube and one end of the twenty-eighth capacitor respectively; an anode of the voltage regulating tube is connected with one end of the fifty-ninth resistor, one end of the sixtieth resistor, and an analog ground respectively; the other end of the fifty-ninth resistor and the other end of the sixtieth resistor are connected with a reference electrode of the voltage regulating tube, the other end of the twenty-eighth capacitor, and one end of the forty-fourth resistor respectively; the optical coupler is connected with the other end of the fifty-seventh resistor and one end of the fifty-eighth resistor respectively; and the optical coupler is connected with the other end of the fiftieth resistor; and the other end of the fifty-eighth resistor is grounded;

the dimming circuit comprises: a sixty-first resistor, a sixty-second resistor, a seventeenth polarity capacitor, an eighteenth polarity capacitor, a tenth diode, an eleventh diode, and a fourth field effect tube;

wherein one end of a first secondary coil in the transformer is connected with a negative electrode of the seventeenth polarity capacitor, a negative electrode of the eighteenth polarity capacitor, one end of the sixty-first resistor, one end of the sixty-second resistor, an analog ground and a source of the fourth field effect tube respectively; a positive electrode of the seventeenth polarity capacitor, a positive electrode of the eighteenth polarity capacitor, the other end of the sixty-first resistor and the other end of the sixty-second resistors are connected with a negative electrode of the tenth diode, a negative electrode of the eleventh diode, one end of the fifty-sixth resistor, one end of the forty-fourth resistor, and a second interface, respectively; a positive electrode of the tenth diode and a positive electrode of the eleventh diode are both connected with the other end of the first secondary coil in the transformer; a drain of the fourth field effect tube is connected with a third interface; and a gate of the four field effect tube is connected with a PWM circuit;

the voltage regulating circuit comprises: a thirteenth diode, a twentieth polarity capacitor, a twenty-first capacitor, and a buck chip; and wherein one end of a second secondary coil in the transformer is connected with a negative electrode of the twentieth polarity capacitor, the buck chip, one end of the twenty-first capacitor, and a protective ground respectively; the other end of the second secondary coil in the transformer is connected with a positive electrode of the thirteenth diode; a negative electrode of the thirteenth diode is connected with a positive electrode of the twentieth polarity capacitor and the buck chip, respectively; and the buck chip is connected with the other end of the twenty-first capacitor;

the LED dimming method further comprises a front panel circuit, wherein the front panel circuit comprises: a front panel control circuit, a Bluetooth chip, a first interface, a second interface, a third interface, a fourth interface, and a fifth interface; and the front panel control circuit comprises: a sixty-third resistor, a sixty-fourth resistor, a thirty-third capacitor, and a thirty-fifth capacitor, wherein the front panel control chip is electrically connected with the first interface, the second interface, the third interface, the fourth interface, the fifth interface, one end of the sixty-second resistor, one end of the sixty-third resistor, one end of the thirty-third capacitor, the thirty-fifth capacitor and the Bluetooth chip respectively; the other end of the sixty-second resistor and one end of the thirty-third capacitor; and the other end of the sixty-third resistor is connected with an analog ground; and the other end of the thirty-third capacitor is connected with the analog ground;

the first interface is respectively electrically connected with the analog ground, an voltage input end and the fourth field effect tube, and outputs a PWM signal to the fourth field effect tube;

the second interface is connected with the analog ground and the front panel control chip respectively, and the second interface is connected with an input apparatus to obtain a user's manual control signal;

the third interface is connected with the analog ground, a power supply, and the front panel control chip respectively;

the fourth interface is connected with one end of the sixty-sixth resistor and the front panel control chip respectively, and the other end of the sixty-sixth resistor is connected with the power supply;

the fifth interface is connected with the power supply, the front panel control chip and a virtual ground respectively;

the front panel control circuit further comprises: a clock circuit, a reset circuit, and a filtering circuit;

the clock circuit comprises: a twenty-ninth capacitor, a thirtieth capacitor, and a first crystal oscillator;

one end of the first crystal oscillator is connected with one end of the twenty-ninth capacitor and the front panel control chip respectively; the other end of the first crystal oscillator is connected with one end of the thirtieth capacitor and the front panel control chip respectively; and the other end of the twenty-ninth capacitor and the other end of the thirtieth capacitor are all connected with the virtual ground;

the reset circuit comprises: a sixty-fifth resistor, a first reset key, and a thirty-second capacitor;

one end of the sixty-fifth resistor is connected with the power supply; the other end of the sixty-fifth resistor is connected with the front panel control chip, one end of the thirty-second capacitor, and one end of the first reset key respectively; and the other end of the thirty-second capacitor and the other end of the first reset key are both connected with the virtual ground;

the filter circuit comprises: a first inductor, a thirty-first capacitor, and a thirty-fourth capacitor; and one end of the first inductor is connected with a voltage input end and one end of the thirty-fourth capacitor respectively; the other end of the first inductor is connected with a power supply and one end of the thirty-first capacitor respectively; and the other end of the thirty-first capacitor and the other end of the thirty-fourth capacitor are both connected with the virtual ground.

* * * * *